US008567373B2

(12) United States Patent
Suda

(10) Patent No.: US 8,567,373 B2
(45) Date of Patent: Oct. 29, 2013

(54) FUEL SUPPLY APPARATUS

(75) Inventor: Toru Suda, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 46 days.

(21) Appl. No.: 13/382,122

(22) PCT Filed: Jul. 3, 2009

(86) PCT No.: PCT/JP2009/003113
§ 371 (c)(1),
(2), (4) Date: Jan. 3, 2012

(87) PCT Pub. No.: WO2011/001478
PCT Pub. Date: Jan. 6, 2011

(65) Prior Publication Data

US 2012/0097132 A1 Apr. 26, 2012

(51) Int. Cl.
*F02M 69/54* (2006.01)
*F02M 69/52* (2006.01)

(52) U.S. Cl.
USPC ..... 123/457; 123/509

(58) Field of Classification Search
USPC ..... 123/457, 458, 459, 462, 509, 511, 512, 123/514; 137/85, 86
See application file for complete search history.

(56) References Cited

U.S. PATENT DOCUMENTS 4,522,177 A * 6/1985 Kawai et al. ..... 123/478
5,590,631 A 1/1997 Tuckey
7,458,362 B2 12/2008 Hazama et al.
7,717,091 B2 5/2010 Aoki et al.
2007/0051340 A1* 3/2007 Tsujimoto ..... 123/378
2009/0071444 A1 3/2009 Takagi et al.

FOREIGN PATENT DOCUMENTS

DE 195 22 512 A1 2/1996
EP 0 248 411 A2 9/1987
JP 64-32066 A 2/1989
JP 08-035459 A 2/1996

(Continued)

OTHER PUBLICATIONS

International Search Report of PCT/JP2009/003113, dated Sep. 8, 2009.

(Continued)

*Primary Examiner* — Mahmoud Gimie
(74) *Attorney, Agent, or Firm* — Sughrue Mion, PLLC

(57) ABSTRACT

A fuel supply apparatus is designed to secure a high fuel pressure to enhance starting operation efficiency and to respond the requirements of low fuel consumption and power saving at the time of starting operation of a fuel consumption unit such as an internal combustion engine, and comprises a fuel pump for supplying fuel reserved in a fuel tank to an engine, a pressure regulator for introducing therein the fuel to be supplied to the engine from the fuel pump and regulating the fuel at a set pressure, the pressure regulator being operative to change the set pressure of the fuel to a high set pressure and a low set pressure, and a set pressure changing unit for changing the set pressure of the pressure regulator into a desired set pressure selected from among the high set pressure and the low set pressure, the set pressure changing unit being operative to allow the set pressure of the pressure regulator at the time of the fuel pump being stopped to be higher than the set pressure of the pressure regulator at the time of the fuel pump being operated.

13 Claims, 9 Drawing Sheets

(56) References Cited

FOREIGN PATENT DOCUMENTS

| | | | |
|---|---|---|---|
| JP | 08-277760 | A | 10/1996 |
| JP | 2001-090624 | A | 4/2001 |
| JP | 2002-235622 | A | 8/2002 |
| JP | 2003-247470 | A | 9/2003 |
| JP | 2003-301752 | A | 10/2003 |
| JP | 2005-351176 | A | 12/2005 |
| JP | 2007-126986 | A | 5/2007 |
| JP | 2007-218222 | A | 8/2007 |
| JP | 2007-278113 | A | 10/2007 |
| JP | 2009-002294 | A | 1/2009 |

OTHER PUBLICATIONS

Supplementary European Search Report dated Jul. 24, 2013 issued in corresponding European Patent Application No. EP 09 84 6772.

* cited by examiner (Mode A)
(During Stop / At Stop of Engine)

(Mode B)

(At Starting Time / Immediately Before Stop)

(Mode C)

(At Partial Load Operation)

FUEL SUPPLY APPARATUS

CROSS REFERENCE TO RELATED APPLICATIONS

This application is a National Stage of International Application No. PCT/JP2009/003113 filed Jul. 3, 2009, the contents of all of which are incorporated herein by reference in their entirety.

FIELD OF INVENTION

The present invention relates to a fuel supply apparatus, and more particularly to a fuel supply apparatus suitable to an internal combustion engine of an automotive vehicle for supplying fuel reserved in a fuel tank to a fuel consumption unit with a fuel pump and for adjusting the supply pressure of the fuel to be supplied to the fuel consumption unit with a pressure regulator.

BACKGROUND OF INVENTION

The fuel supply apparatus of this type for the internal combustion engine to be mounted on the automotive vehicle, comprises a fuel pump for discharging fuel in a fuel tank, and a pressure regulator for adjusting supplying pressure (hereinafter simply referred to as "fuel pressure") of the fuel to be supplied to an injector from the fuel pump. The pressure regulator generally comprises a case, a diaphragm provided in the case to separate the inner space of the case into two chambers, a pressure regulation valve provided on central portion of the diaphragm to be opened and closed in response to the fuel pressure varied in one of the two chambers, viz., a pressure regulation chamber and a back pressure chamber, and a spring (compression coil spring) provided in the case to urge the diaphragm against the fuel pressure varied in the pressure regulation chamber toward the back pressure chamber so that the pressure regulation valve can be maintained in a closed state to have the pressure of the pressure regulation chamber reach the preliminarily set pressure. In general, there are many cases in which the pressure regulator is arranged together with the fuel pump in the fuel tank.

The fuel supply apparatus equipped with the pressure regulator of this kind is known in the art, and comprises a back pressure raising circuit having an electromagnet valve and capable of introducing the fuel discharged from the fuel pump into the back pressure chamber so that the pressure (hereinafter simply referred to as "back pressure") of the fuel in the back pressure chamber can be raised to change the pressure of the fuel to be regulated in the pressure regulation chamber into a higher pressure. The known fuel supply apparatus is designed to use another pressure regulator and a throttling element operable in cooperation with the pressure regulator other than the pressure regulator for adjusting the pressure of the fuel to be supplied to the injector so that the pressure of the fuel to be introduced into the back pressure chamber can be adjusted to a preliminarily set pressure (see for example Patent Document 1 listed below).

Another known fuel supply apparatus is provided with a three-way electromagnetic valve in a back pressure raising circuit to have fuel discharged from a fuel pump introduced into a back pressure chamber of a pressure regulator at the time of the three-way electromagnetic valve being energized, i.e., "ON" while to have the back pressure chamber opened to the inner pressure space of the fuel tank or to the atmospheric pressure space at the time of the three-way electromagnetic valve being deenergized, i.e., "OFF" (see for example Patent Document 2).

A further known fuel supply apparatus comprises a first feed pump, a second feed pump arranged in series at the downstream of the first feed pump, a first pressure regulator for adjusting the pressure of fuel discharged from the first feed pump to a first preliminarily set pressure, and a second pressure regulator having a back pressure chamber for introducing the discharge pressure therein at the time of the operation of the first feed pump to adjust the discharge pressure of the second feed pump to a second preliminarily set pressure, so that the fuel supply apparatus can supply the fuel at a relatively high pressure with the first feed pump and the second feed pump positioned at a relatively low head as well as can make it possible to perform the change between the high pressure and the low pressure (see for example Patent Document 3).

A still further known fuel supply apparatus comprises determination means for determining whether or not there can be vapors generated in pipes allowing fuel to pass therethrough, so that when the determination means determines that the vapors can possibly be generated in the pipes, the fuel under pressure is introduced into the back pressure chamber of the pressure regulator (see for example Patent Document 4).

A yet still further known fuel supply apparatus comprises a fuel supply pipe for connecting a fuel pump with an injector, a return pipe held in connection with the fuel supply pipe and having a plurality of throttling elements. From between the throttling pipes is taken out an intermediate pressure to be introduced into the back pressure chamber, while the fuel passing through the return pipe is returned to a fuel tank (see for example Patent Document 5).

A yet still further known fuel supply apparatus comprises a return pipe, and a valve for opening and closing the flow of the fuel to the return pipe (see for example Patent Document 6).

The other known fuel supply apparatus comprises a low pressure feed pump, a pressurization pump disposed in series at the downstream of the low pressure feed pump, a driving source for driving the low pressure feed pump and the pressurization pump with a common shaft, and a check valve provided between the pressurization feed pump and a common rail to have the fuel pass to the common rail from the pressurization feed pump through the check valve, a booster having a pressure chamber held in communication with the inside of the common rail and capable of pressurizing the fuel in the pressure chamber by a piston, and a motion converting mechanism capable of converting the rotation of the rotation shaft for driving the pump to the linear motion. The piston of the booster is driven through the motion converting mechanism at the starting time of the fuel supply apparatus, thereby making it possible for the pressure of the common rail to be rapidly increased at the starting time of the fuel supply apparatus (see for example Patent Document 7).

Further, the last known fuel supply apparatus is designed to estimate an evaporating fuel concentration in a fuel/air mixture in accordance with the value of compensation to compensate a fuel/air ratio to a target fuel/air ratio, and to drive a fuel pump at a rotation speed higher than a usual rotation speed when the evaporating fuel concentration exceeds a predetermined evaporating fuel concentration level (see for example Patent Document 8).

PRIOR ART TECHNOLOGY DOCUMENT

Patent Documents

Patent Document 1: Japanese Patent Application Publication No. 2007-278113

Patent Document 2: Japanese Patent Application Publication No. 2009-2294

Patent Document 3: Japanese Patent Application Publication No. 2003-301752

Patent Document 4: Japanese Patent Application Publication No. 2007-218222

Patent Document 5: Japanese Patent Application Publication No. 2002-235622

Patent Document 6: Japanese Patent Application Publication No. 2001-90624

Patent Document 7: Japanese Patent Application Publication No. 2005-351176

Patent Document 8: Japanese Patent Application Publication No. 2007-126986

SUMMARY OF INVENTION

Problems to be Solved by Invention

The above fuel supply apparatuses disclosing the respective prior arts as previously mentioned, come to retain a low residual pressure in the fuel supply passageway between the fuel pump (more specifically indicative of a check valve positioned in the neighborhood of the discharge port of the fuel pump) and the injector when the fuel pump is stopped in response to the stop of the engine, thereby rendering it impossible to retain the fuel pressure at a high level in the fuel supply passageway. This results in the fact that at the time of the engine being restarted, especially at the time of the engine being restarted at the high temperature of the fuel, the pressure regulator lacks its back pressure, thereby leading to lowering the regulated output pressure and generating fuel vapor in the fuel supply passageway, so that the known fuel supply apparatus encounters such a problem that the operation state of the internal combustion engine comes to be unstable.

In view of these problems encountered by the conventional fuel supply apparatuses, it may, however, be considered that the fuel supply apparatuses are designed to raise the set pressure of the pressure regulator to secure a certain high degree of fuel pressure at the time of the engine being started. Simply increasing the set pressure of the pressure regulator leads to increasing the load of the fuel pump in the normal operation state, thereby making it impossible to respond recent requirements for extremely low fuel consumption and excellent electric power saving.

It is, therefore, an object of the present invention to provide a fuel supply apparatus which can secure a high fuel pressure at the time of starting the fuel consumption unit such as an internal combustion engine and the like to enhance the starting operation property of the fuel consumption unit as well as can meet requirements for low fuel consumption and electric power saving.

Means for Solving Problems

The fuel supply apparatus according to the present invention is made to solve the foregoing problems, and comprises a fuel pump for supplying fuel reserved in a fuel tank to a fuel consumption unit; a pressure regulator for introducing therein the fuel to be supplied to the fuel consumption unit from the fuel pump and regulating the fuel to a set pressure, the pressure regulator being operative to change the set pressure of the fuel to a high set pressure and a low set pressure; and a set pressure changing unit for changing and controlling the set pressure of the pressure regulator into a desired set pressure selected from among the high set pressure and the low set pressure; the set pressure changing unit being operative to allow the set pressure of the pressure regulator at the time of the fuel pump being stopped to be higher than the set pressure of the pressure regulator at the time of the fuel pump being operated.

By the construction of the fuel supply apparatus as set forth in the above, the set pressure changing unit is operative to allow the set pressure of the pressure regulator at the time of the fuel pump being stopped to become high, while to immediately start supplying the fuel at a sufficient fuel pressure, and thus leading to securing a high fuel pressure at the time of the fuel pump being operated. This means that the fuel vapor can be prevented from being generated, thereby enhancing the starting operation property at the time of the fuel consumption unit being started to be operated.

In the fuel supply apparatus thus constructed in the above, the pressure regulator is preferably operated by an operation fluid pressure introduced therein to regulate the fuel pressure from the fuel pump to the high set pressure when the operation fluid pressure is lowered. The above construction leads to the fact that the set pressure of the pressure regulator can easily and reliably be set at the high pressure state, thereby making unnecessary for the power serving to increase the operation fluid pressure for the purpose of increasing the set pressure at the time of the fuel consumption unit being started to be operated. In addition, the fuel pressure in the high pressure state can stably be secured in the state that the operation fluid pressure is lowered. Further, the term "operation fluid" is intended to mean an operation fluid pressure for applying an operation force on a portion serving as a valve element in the pressure regulator.

Further, the pressure regulator previously mentioned may preferably regulate the fuel pressure from the fuel pump to the low set pressure state at the time of the operation fluid pressure coming to be high. The above construction leads to the fact that at the time of a normal operation having the operation fluid pressure easy to secure, the fuel pressure at the low set pressure can stably be secured in the state that the operation fluid pressure is raised, thereby making it possible to suppress the load of the fuel pump at the time of the normal operation.

In the fuel supply apparatus according to the present invention, it is preferable that the fuel consumption unit be constituted by a fuel injection unit of an internal combustion engine, and the set pressure changing unit be operative to lower the operation fluid pressure to have the set pressure of the pressure regulator transferred to the high set pressure in advance of the internal combustion engine being stopped when the internal combustion engine is stopped. The above construction leads to the fact that when the internal combustion engine is stopped, the timing of lowering the operation fluid pressure is simply adjusted, thereby making it possible to have the set pressure of the pressure regulator brought into the high state on the way to the stop of the internal combustion engine. It will therefore be understood that when the fuel pump is operated at time of the starting operation or the high temperature repeated starting operation, the fuel supply can be immediately started at the sufficiently high fuel pressure, thereby making it possible to secure the high fuel pressure at the starting time of the engine.

In any one of the above fuel supply apparatus, the set pressure changing unit is preferably operative to maintain the operation fluid pressure at an atmospheric pressure to have the set pressure of the pressure regulator transferred to the high set pressure before the fuel pump is driven. The above construction leads to the fact that when the set pressure of the pressure regulator is transferred to the high set pressure, the engine is by no means imparted unnecessary load thereon for obtaining the operation fluid pressure at the time of the starting operation or the high temperature repeated starting operation.

Further, the set pressure changing unit is preferably operative to supply the operation fluid pressure to the pressure regulator on the basis of the pressure of the fuel discharged from the fuel pump when the set pressure of the pressure regulator is transferred to the low set pressure. The above construction makes it unnecessary to provide a pressure source exclusive for the operation fluid pressure.

The fuel supply apparatus thus constructed in the above, further preferably comprises a check valve provided between the fuel pump and the pressure regulator and operative to be opened when the fuel is supplied to the fuel injection unit of the internal combustion engine from the fuel pump and to check the fuel reversed in a backward direction to the fuel pump from the fuel injection unit of the internal combustion engine, and in which the set pressure changing unit is operative to supply the operation fluid pressure to the pressure regulator on the basis of the pressure of the fuel at the upstream of the check valve. The check valve can check the backward flow of the fuel discharged from the fuel pump to the fuel injection unit, effectively maintaining the predetermined pressure of the fuel in the fuel supply passageway, and making it possible for the operation fluid pressure to be raised at an early stage at the time of starting the fuel pump.

The set pressure changing unit is preferably constituted by an electromagnetic valve operative to supply the fuel discharged from the fuel pump to the pressure regulator as the operation fluid pressure when the electromagnetic valve is deenergized. By this construction, it is possible to maintain the electromagnetic valve operative in the state of being deenergized during the normal operation of the engine in which the fuel from the fuel pump is regulated exclusively to the low set pressure, thereby making it possible to respond the requirements of low fuel consumption and power saving.

Further, the electromagnetic valve is preferably constituted by a three-way valve having a first port allowing the fuel from the fuel pump to be introduced therein, a second port allowing the operation fluid pressure to be supplied to the pressure regulator, and a third port allowing the internal pressure of the fuel tank or the atmospheric pressure to be introduced therein, the first port being held in communication with the second port when the three-way valve is deenergized while the third port being held in communication with the second port when the three-way valve is energized. The above construction leads to the fact that the fuel pressure discharged from the fuel pump can be supplied to the second port serving as an operation fluid pressure supply port when the three-way valve is deenergized, while the second port can be opened to the inside of the fuel tank or the atmospheric pressure space when the three-way valve is energized, thereby making it possible to reliably change the set pressure while retaining the power saving.

In the fuel supply apparatus thus constructed in the above, the pressure regulator preferably comprises a case, a fuel pressure regulation valve provided in the case and operative to assume an opened state and an closed state, the fuel pressure regulation valve being operative to regulate the fuel pressure by discharging the fuel from the fuel pump to the fuel tank when the fuel pressure regulation valve is held in an opened state, a first urging unit for urging the fuel pressure regulator toward the closed state to have the fuel pressure regulator held in the closed state until the fuel pressure from the fuel pump reaches the high set pressure, and a second urging unit for urging the fuel pressure regulator toward the opened state on the basis of the operation fluid pressure.

By the construction of the fuel supply apparatus as set forth in the above, the fuel pressure held at the high set pressure can reliably be secured in response to the urging force of the first urging unit when the operation fluid pressure is lowered, while the fuel pressure regulation valve is urged toward the opened state in response to the urging force of the second urging unit when the operation fluid pressure is raised, thereby making it possible to stably secure the low set fuel pressure. It is therefore possible to reliably change the set pressure of the pressure regulator, using the fluid pressurized from a desired operation fluid pressure source.

Further, the pressure regulator preferably comprises a separation wall member having a displaceable portion constructed to separate the case into a pressure regulation chamber and a back pressure chamber and displaceable in response to the difference in fuel pressure between the pressure regulation chamber and the back pressure chamber, the fuel pressure regulation valve being operative to be opened and closed in response to the displaced positions of the displaceable portion in the pressure regulation chamber. This makes it possible to more reliably change the set pressure than using the operation fluid pressure.

The second urging unit preferably has a pressure receiving member provided in the case to form an operation pressure chamber allowing the operation fluid pressure introduced in the case and to receive the operation fluid pressure in the pressure operation pressure chamber, the pressure receiving member being operative to transmit its the operation force from the pressure receiving member to the displaceable portion in the direction in which the fuel pressure regulation valve is brought into the opened state. This construction can make it possible to increase the freedom degree in the disposition of the second urging unit, while making the urging direction of the urging force of the second urging unit to be opposite to the urging direction of the urging force of the first urging unit.

Further, the second urging unit preferably has a resilient member provided between the pressure receiving member and the displaceable portion of the separation wall member to transmit the operation force from the pressure receiving member to the displaceable portion in the direction in which the fuel pressure regulation valve is brought into the opened state. The above construction leads to the fact that the operation force can be transmitted to the displaceable portion from the pressure receiving member, and the pressure receiving member can be returned to the original position when the operation fluid pressure is lowered, thereby making the set pressure changing unit simple in construction.

In the fuel supply apparatus having the operation pressure chamber and the back pressure chamber in the case, the operation pressure chamber is preferably positioned in opposing relationship with the back pressure chamber across the pressure regulation chamber, the pressure receiving member having a one side pressure receiving portion positioned in the operation pressure chamber and the other side operation force transmitting portion positioned in the pressure regulation chamber. The above construction makes it possible to have the urging force of the first urging unit opposite to the urging force of the second urging force, and to increase the freedom degree in the disposition of the second urging unit, and to ensure the reliable operation force transmission in response to the operation fluid pressure.

In the fuel supply apparatus having the back pressure chamber in the case, the first urging unit preferably has a resilient member provided between the inner bottom portion and the separation wall portion of the case in the back pressure chamber to be used for setting the high pressure of the fuel, the case being formed with an opening hole for allowing the back pressure chamber to be opened to the exterior space of the case, thereby making the set pressure changing unit simple in construction to have the first urging unit stably secure the high set pressure.

Effect of Invention

The present invention can provide a fuel supply apparatus which can secure a high fuel pressure at the time of starting the fuel consumption unit such as an internal combustion engine and the like to enhance the starting operation property of the fuel consumption unit as well as can meet requirements for low-fuel consumption and electric power saving.

EMBODIMENT TO CARRY OUT INVENTION

The preferred embodiment of the present invention will be described hereinafter with reference to the accompanying drawings.

FIGS. 1 to 5 show a schematic construction and a plurality of operation modes of the fuel supply apparatus according to one preferred embodiment of the present invention. The present embodiment is shown as an example applied to the present invention and used for a fuel supply apparatus of an internal combustion engine to be mounted on an automotive vehicle.

The construction of the present embodiment will firstly be described.

Figure 1:
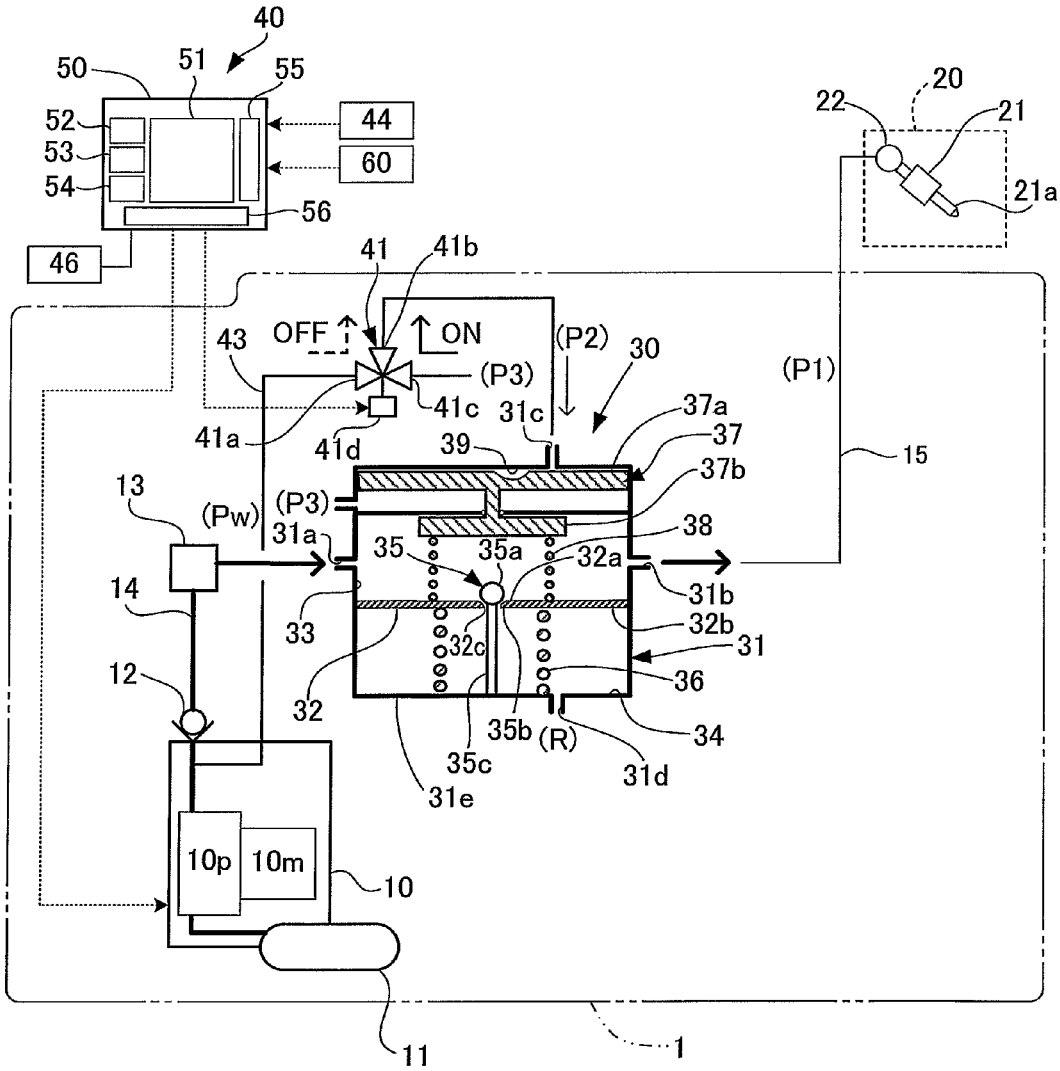
FIG. 1 is a schematic construction view of an overall fuel supply apparatus according to one embodiment of the present invention.

As shown in FIG. 1, the fuel supply apparatus according to the present embodiment comprises a fuel tank 1 mounted on the automotive vehicle, a fuel pump 10 for supplying fuel reserved in the fuel tank 1 to at least one injector 21, for example, a plurality of injectors 21 (only one injector is shown in FIG. 1) forming part of an engine 20 (internal combustion engine, fuel consumption unit), a pressure regulator 30, and a set pressure changing unit 40. The pressure regulator 30 is adapted to allow the fuel to be introduced therein, the fuel being to be supplied to each of the injectors 21 from the fuel pump 10. The pressure regulator 30 is capable of adjusting the pressure of the fuel to a preliminarily set pressure, i.e., system pressure P1 and changing the set pressure into either one of two different pressures, viz., a high set pressure and a low set pressure. This means that the pressure regulator 30 serves to variably control the pressure of the fuel introduced therein from the fuel pump 10. The set pressure changing unit 40 is capable of changing and controlling the set pressure of the pressure regulator 30 into a desired set pressure selected from among the high set pressure and the low set pressure.

The engine 20 is constituted by an internal combustion engine having a plurality of cylinders such as, for example, a 4-cycle gasoline engine of a port injection type to be mounted on an automotive vehicle. The fuel tank 1 therefore has a gasoline as a fuel reserved therein. Further, it is to be noted that the present invention may, of course, be applied to a fuel supply apparatus to be used for the internal combustion engines of the types such as a dual injection type and an inner cylinder injection type other than the above mentioned gasoline engine of the port injection type.

The fuel pump 10 is constructed for example by a pump comprising an operation portion 10*p* having a plurality of vanes to be used as a pumping operation, and an electric motor 10*m* accommodated to be operated by a direct current to drive the operation portion 10*p*, so that the fuel can be pumped up and discharged in a pressurized state from the fuel tank 1 by the fuel pump 10 and the amount of discharged fuel can be controlled to be varied per a unit time with the motor rotation speed (rpm) being varied by the electric motor.

The fuel pump 10 has an inlet side having a suction filter 11 and a discharge side having a check valve 12 for preventing the fuel discharged from the fuel pump 10 from being flowed (introduced) back into the fuel pump 10, viz., checking the fuel to be returned to the fuel pump 10. On the fuel path 14 between the fuel pump 10 and the pressure regulator 30 is provided a fuel filter 13 serving to remove foreign objects contained in the fuel. The check valve 12 is operative to take an opened state allowing the fuel to be supplied from the fuel pump 10 to the injector 21, and a closed state having the fuel blocked to be reversed in a backward direction from the injector 21 to the fuel pump 10, so that the fuel discharged from the fuel pump 10 can be prevented from being returned to the fuel pump 10.

The fuel pump 10 is operated by an electronic control unit (hereinafter simply referred to as "ECU") 50 which serves to control the energization and deenergization of the electric motor 10*m* so that the electric motor 10*m* can be selectively rotated or stopped by the ECU 50. More specifically, the electric motor 10*m* of the fuel pump 10 is operated in response to the control signal from the ECU 50 to be selectively driven or stopped. The electric current energized and controlled to the electric motor 10*m* of the fuel pump 10 makes it possible to have the amount of the fuel discharged from the pump 10 varied per a unit time.

The previously mentioned plurality of injectors 21 constitute a fuel injection unit forming part of the engine 20 and are provided respectively to a plurality of cylinders in such a manner that the injection side ends 21*a* of the injectors 21 are positioned at intake air passages, i.e., inlet ports (not shown) corresponding to the cylinders, respectively. The fuel supplied through the pressure regulator 30 from the fuel pump 10 is distributed to the injectors 21 through a delivery pipe 22.

The pressure regulator 30 comprises a case 31 circular in cross-section and formed with a fuel inlet port 31*a*, a fuel discharge port 31*b*, an operation pressure inlet port 31*c*, and a return port 31*d*, a fuel pressure regulation valve 35 provided in the case 31 and operative to take an opened state and a closed state so that the fuel can be regulated by discharging part of the fuel from the fuel pump 10 into the fuel tank 1 when the fuel pressure regulation valve 35 takes the opened state. The pressure regulator 30 further comprises a compression coil spring 36 (first urging unit, resilient member to be used for setting the high set pressure) to be used for setting a high set pressure, a pressure receiving member 37, and a compression coil spring 38 to be used for setting a reduced pressure. The compression coil spring 36 serves to retain the fuel pressure regulation valve 35 in the closed state until the pressure of the fuel from the fuel pump 10 reaches the high set pressure, and thus constitutes a first urging unit, viz., a resilient member to be used for setting the high set pressure. The pressure receiving member 37 and the compression coil spring 38 constitute a second urging unit for urging the fuel pressure regulation valve 35 in its opening direction by the operation fluid pressure P2 to set a low set pressure. The pressure P3 shown in FIG. 1 indicates an internal pressure in the fuel tank 1 or a pressure level equal to the atmospheric pressure at each of the ports.

Here, the high set pressure is for example 400 (kPa) (gauge pressure; hereinafter the same applies) which is a set value, viz., a fuel pressure (usually more than 324 kPa) difficult to cause fuel vapor even if the temperature of the fuel in the delivery pipe 22 becomes at a high level immediately after the stop of the engine. On the other hand, the low set pressure is for example 200 (kPa), and a set value, viz., a fuel pressure difficult to cause fuel vapor if the temperature of the fuel in the delivery pipe 22 becomes at a relatively low level during the cruising operation of the automotive vehicle.

The pressure regulator 30 further comprises a separation wall member 32 in the form of a diaphragm and having a displaceable portion 32*a* constructed to separate the case 31 into a pressure regulation chamber 33 and a back pressure chamber 34 and displaceable in response to the difference in fuel pressure between the pressure regulation chamber 33 and the back pressure chamber 34. The fuel pressure regulation valve 35 is operative to be opened and closed in response to the displaced positions of the displaceable portion 32*a* in the pressure regulation chamber 33.

More specifically, the separation wall member 32 is constituted by the displaceable portion 32*a* positioned at the center thereof and made for example of a hard disc-shaped material, and an annular portion 32*b* in the form of a resilient membrane shape surrounding the displaceable portion 32*a* and having a flexible property, so that the displaceable portion 32*a* can be displaced up and down in FIG. 1 in response to the urging forces received alternately from the pressure regulation chamber 33 and the back pressure chamber 34. According to the present invention, the displaceable portion 32*a* may be in the form of an overall disc-like shape and constructed to have a seal portion at its outer peripheral portion and slidable with respect to the inner surface of the case 31 to hermetically seal and separate the pressure regulation chamber 33 and the back pressure chamber 34.

The displaceable portion 32*a* of the separation wall member 32 is formed with for example a central hole 32*c* circular in cross-section to have an annular valve seat 35*b* for allowing a valve body 35*a*, in the form of a roughly spherical shape, of the fuel pressure regulation valve 35 to be seatable on the annular valve seat 35*b*. The valve seat surface of the annular valve seat 35*b* is for example in the form of a conical shape.

The spherical valve body 35*a* of the fuel pressure regulation valve 35 is secured to and supported by the case 31 through a stem member 35*c* vertically extending as shown in FIG. 1, so that the displaceable portion 32*a* of the separation wall member 32 resiliently urged upwardly in FIG. 1 by the compression coil spring 36 is regulated from being moved upwardly in FIG. 1 by the spherical valve body 35*a*. This means that the spherical valve body 35*a* and the stem member 35*c* of the fuel pressure regulation valve 35 constitute as a whole a stopper unit functioning to regulate the upper limit of the upward movement of the displaceable portion 32*a* of the separation wall member 32, viz., the increased set pressure side.

The pressure receiving member 37 is provided in the case 31 to partly define an operation pressure chamber 39 allowing the operation fluid pressure to be introduced therein and adapted to receive the operation fluid pressure P2 in the pressure chamber 39. The pressure receiving member 37 is constructed in such a manner that the operation force in the direction having the fuel pressure regulation valve 35 opened is transmitted as a mechanical operation force but not in a fluidal operation force from the pressure receiving member 37 to the displaceable portion 32*a* of the separation wall member 32. Between the pressure receiving member 37 and the displaceable portion 32*a* of the separation wall member 32 is provided the pressure reducing compression coil spring 38 which serves to transmit the operation force from the pressure receiving member 37 to the displaceable portion 32*a* in the direction having the fuel pressure regulation valve 35 opened.

The pressure regulator 30 is operative to downwardly move the displaceable portion 32*a* of the separation wall member 32 with respect to the spherical valve body 35*a* of the fuel pressure regulation valve 35, viz., to open the fuel pressure regulation valve 35 when the operation force is transmitted from the pressure receiving member 37 to the displaceable portion 32*a* in the direction having the fuel pressure regulation valve 35 opened. This means that the fuel in the pressure regulation chamber 33 is leaked to the back pressure chamber 34 through the fuel pressure regulation valve 35, so that the pressure of the fuel in the pressure regulation chamber 33 can be regulated to the low pressure. The fuel leaked to the back pressure chamber 34 is discharged to the fuel tank 1 through the return port 31*d*.

Further, the pressure receiving member 37 is adapted to transmit to the displaceable portion 32*a* the operation force having the fuel pressure regulation valve 35 opened when the discharge pressure Pw from the fuel pump 10 is supplied to the operation pressure chamber 39 as an operation fluid pressure P2. This leads to the fact that the fuel from the fuel pump 10 is regulated to the low set pressure in the pressure regulation chamber 33 when the discharge pressure Pw from the fuel pump 10 is supplied to the operation pressure chamber 39 as the operation fluid pressure P2.

On the other hand, the pressure receiving member 37 is returned to the original position shown in FIG. 1 by the urging force, i.e., the reaction force of the compression coil spring 38 to have the fuel pressure regulation valve 35 closed when the operation fluid pressure P2 supplied to the operation pressure chamber 39 is decreased to the internal pressure of the fuel tank 1 or the atmospheric pressure P3 (hereinafter simply referred to as "internal pressure P3 of the fuel tank 1"). This means that the fuel from the fuel pump 10 is regulated to the high set pressure in the pressure regulation chamber 33 when the operation pressure chamber 39 is opened to the space of the internal pressure of the fuel tank 1 or the space of the atmospheric pressure.

In this way, the pressure regulator 30 can change and regulate the set pressure to a desired set pressure selected from among the high set pressure and the low set pressure both of which are preliminarily set for the fuel in the pressure regulation chamber 33 by selectively introducing into the pressure regulation chamber 33 the fuel discharged from the fuel pump 10 to the injector 21 of the engine 20. Therefore, the fuel from the fuel pump 10 can be regulated to the high set pressure when the operation fluid pressure P2 is decreased.

The set pressure changing unit 40 is designed to conduct the control of changing the set pressure of the pressure regulator 30, and thus to selectively change the set pressure of the pressure regulator 30 to the high set pressure or the low set pressure (variable control). For the control of changing the set pressure of the pressure regulator 30, the set pressure changing unit 40 comprises a three-way electromagnetic valve 41, an ECU 50, and a relay switch 24. The three-way electromagnetic valve 41 (electromagnetic valve, three-way valve) is well known in the art and adapted to introduce selectively to the pressure regulation chamber 33 the fuel discharged from the fuel pump 10 to be supplied to the injector 21. The ECU 50 is designed to control the energization state (energization (ON)/deenergization (OFF)) of an electromagnetic operation portion 41*d* forming part of the three-way electromagnetic valve 41. The relay switch 24 will hereinafter be described in detail. The three-way electromagnet valve 41 is adapted to open a pressure supply passageway 43 to the operation pressure chamber 39 and thus to allow the pressure of the fuel discharged from the fuel pump 10 to be introduced into the operation pressure chamber 39 through the pressure supply passageway 43 when the three-way electromagnetic valve 41 is deenergized.

More specifically, the three-way electromagnetic valve 41 comprises a first port 41*a* allowing the fuel pressure from the fuel pump 10 to be introduced therethrough, a second port 41*b* allowing the operation fluid pressure P2 to be supplied therethrough to the operation pressure chamber 39, and a third port 41*c* allowing the internal pressure P3 of the fuel tank 1 to be introduced therethrough. The electromagnetic operation portion 41*d* of the three-way electromagnetic valve 41 is operated to be energized or deenergized by the ECU 50, and thus adapted to take an deenergized state to have the second port 41*b* held in communication with the first port 41*a*, and an energized state to have the second port 41*b* held in communication with the third port 41*c*.

The ECU 50 comprises a CPU (Central Processing Unit) 51, a backup memory 54, an input interface circuit 55, and an output interface memory 56. The backup memory 54 is constituted by a non-volatility memory such as a ROM (Read Only Memory) 52, a RAM (Random Access Memory) 53, and an EEPR (Electrically Erasable and Programmable Read Only Memory) 53. The ECU 50 is operative to be fed with a signal representative of "ON" or "OFF" from an ignition switch 44 provided on the automotive vehicle, and to be supplied with electricity from a battery 46.

Figure 2:
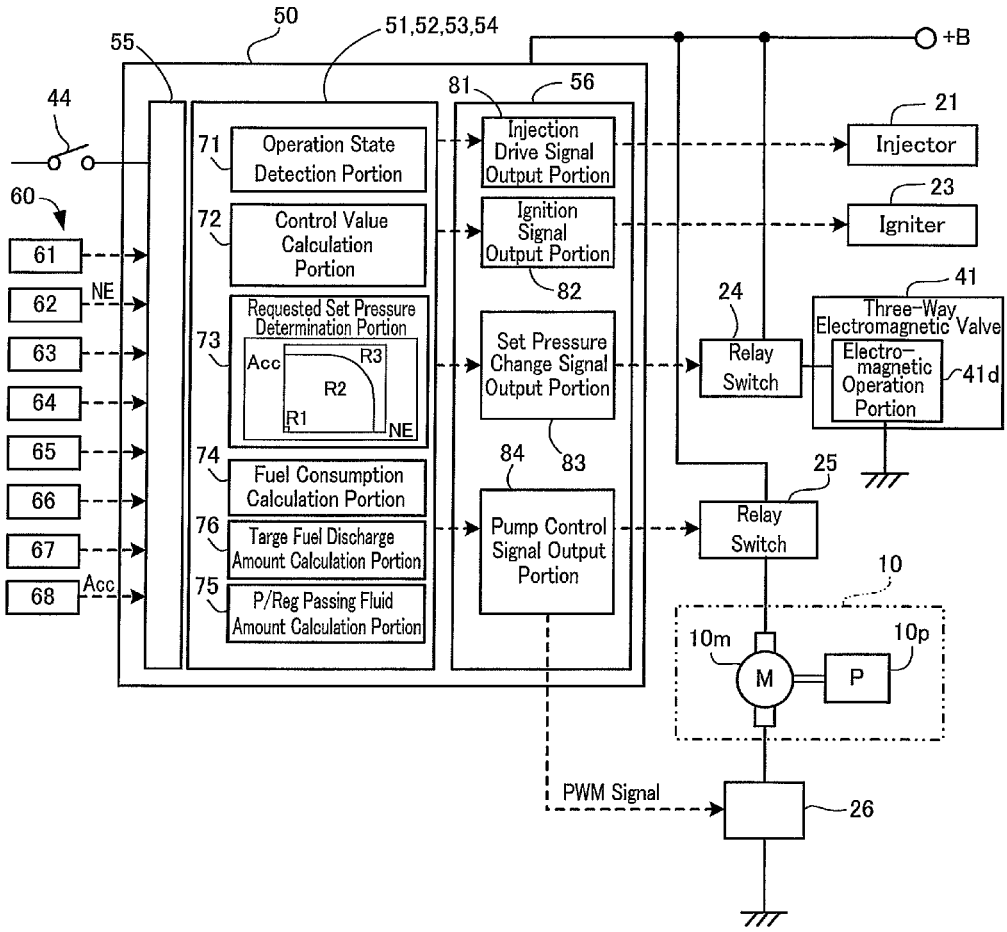
FIG. 2 is a construction view of a control system assembled in the fuel supply apparatus according to one embodiment of the present invention.

The input interface circuit 55 of the ECU 50 is shown in FIG. 2 as being connected to a sensor group 60 including an airflow meter 61, a rotation speed sensor 62, a throttle sensor 63, an oxygen sensor 64, a cylinder determination sensor 65, an inlet air temperature sensor 66, a water temperature sensor 67, an acceleration opening degree sensor 68, so that the ECU 50 can be fed with sensor information from the sensor group 60 through the input interface circuit 55 such as an A/D converter and the like.

As shown in FIGS. 1 and 2, the output interface circuit 56 of the ECU 50 is connected to the injector 21 forming part of the fuel injection unit, an igniter 23 for driving an ignition plug, relay switches 24 and 25 for controlling actuators such as the fuel pump 10 and the three-way electromagnetic valve 41, and a switching element 26 for variably controlling the electric current to the fuel pump 10, so that the output interface circuit 56 of the ECU 50 can control the electricity to be fed to the actuators from the battery 46. Here, the switching element 26 is constituted by a transistor of a MOS-FET (Metal-Oxide-Semiconductor Field-Effect Transistor) type which can variably control the electric current to the coil in the electric motor 10*m* of the fuel pump 10 in response to for example the PWM (Pulse Width Modulation) input signal.

The ECU 50 is operative to have the CPU 51 execute an arithmetic processing mainly in compliance with the control program stored in the ROM 52 on the basis of the information obtained from the various sensors through the input interface circuit 55, and the information about the set values and the maps preliminarily stored in the ROM 52 and the backup memory 54 while the data is being exchanged between the RAM 53 and the backup memory 54. In response to the result of the arithmetic processing by the CPU 51, the output interface circuit 56 is operative to output a control signal, so that the electronic control of the engine 20 can be realized, while performing a fuel pressure changing control which will become apparent as the description proceeds.

The ECU 50 is more specifically constituted by a plurality of function units as shown by a block diagram in FIG. 2.

The CPU 51, the ROM 52, the RAM 53, and the backup memory 54 collectively constituting the ECU 50 are adapted to execute the control program mainly stored in the ROM 52, using the information about the set values and the maps stored in the ROM 52, the RAM 53, and the backup memory 54. The CPU 51, the ROM 52, the RAM 53, and the backup memory 54 of the ECU 50 function to operate an operation state detection portion 71, a control value calculation portion 72, a requested set pressure determination portion 73, a fuel consumption calculation portion 74, a P/Reg passing fluid amount calculation portion 75, and a target fuel discharge amount calculation portion 76. The operation state detection portion 71 is operative to detect the operation state of the automotive vehicle in accordance with the information of the sensors 60. The control value calculation portion 72 is operative to calculate the control values for electronically controlling the engine 20 such as for example fuel injection times, ignition timings, throttle opening degrees, and load levels to be requested. The requested set pressure determination portion 73 is operative to obtain the information relative to the operation state (for example whether or not the fuel injection amount to be requested is over the threshold value to be used for the fuel pressure change determination) requested by the engine 20 on the basis of the result calculated by the control value calculation portion 72, and to determine in accordance with the determination map the data of which is preliminarily stored in the ROM 52 or the backup memory 54 on whether the requested set pressure of the fuel is the high set pressure or the low set pressure. The fuel consumption calculation portion 74 is operative to periodically calculate the fuel consumption amount requested on the basis of the requested fuel injection time calculated by the control value calculation portion 72 and the set pressure of the fuel. The P/Reg passing fluid amount calculation portion 75 is operative to calculate the amount of the fuel to be returned to the fuel tank 1 from the pressure regulator 30 on the basis of the fuel discharge amount of the fuel pump 10 calculated from the energization state of the fuel pump 10 and the fuel injection time calculated by the control value calculation portion 72. The target fuel discharge amount calculation portion 76 is operative to calculate the target fuel discharge amount on the basis of the requested fuel consumption amount calculated by the fuel consumption calculation portion 74 and the return fuel amount calculated by the P/Reg passing fluid amount calculation portion 75.

The output interface circuit 56 of the ECU 50 is constituted by an injection drive signal output portion 81, an ignition signal output portion 82, a set pressure change signal output portion 83, and a pump control signal output portion 84. The injection drive signal output portion 81 is operative to output an injection drive pulse to the injector 21 on the basis of the result calculated by the control value calculation portion 72. The ignition signal output portion 82 is operative to output an ignition signal to the igniter 23. The set pressure change signal output portion 83 is operative to output a set pressure change signal indicative of changing the set pressure of the pressure regulator 30 into any one of the high set pressure and the low set pressure in response to the result determined by the requested set pressure determination portion 73. The pump control signal output portion 84 is operative to output the pump drive pulse signal of the PWM type in response to the target fuel discharge amount of the fuel pump 10, and the relay change signal for initiating driving the fuel pump 10 when the starter signal and the engine rotation signal are inputted therein in a predetermined time interval.

The relay switch 24 intervenes between the electromagnetic operation portion 41*d* of the three-way electromagnetic valve 41 and the battery 46 (indicated by the reference legend "+B" in FIG. 2, hereinafter simply referred to as "battery electric source"). Here, the set pressure change signal output portion 83 is operative to selectively feed or stop the electric current for energizing the coil of the relay switch 24 in response to the result determined by the requested set pressure determination portion 73, so that the ON/OFF of the relay switch 24 can be changed, thereby rendering the energization and deenergization states of the three-way electromagnetic valve 41 to be changed. The operation to selectively feed or stop the electric current to the coil of the relay switch 24 makes it possible to have the set pressure of the regulator 30 to be changed into any one of the high set pressure and the low set pressure.

Further, the pump control signal output portion 84 is designed to control the rotation speed of the electric motor 10*m* of the fuel pump 10 to supply the injection amount of fuel to be requested in cooperation with the relay switch 25 and the switching element 26. When the requested fuel injection amount is smaller than the preliminarily set fuel injection amount, the pump control signal output portion 84 can decrease the discharge amount of fuel from the fuel pump 10 by controlling to decrease the amount of fuel to be returned to the fuel tank 1 from the pressure regulator 30. The electric motor 10*m* is provided with a clamp diode or a condenser both of which are well known in the art and functions to clamp voltage generated in the motor coil of the electric motor and to regulate the electric current direction.

The ECU thus constructed in the above is operative to execute the program stored in the ROM 52 to operate the operation state detection portion 71, the control value calculation portion 72, and the requested set pressure determination portion 73 based on the sensor information obtained from the sensors 60 as well as the information about the set values and the maps preliminarily stored in the ROM 52 and the backup memory 54. At the starting time of the engine 20, the three-way electromagnetic valve 41 is maintained in the energized state to have the second port 41*b* held in communication with the third port 41*c*. At this time, the operation fluid pressure P2 supplied to the operation pressure chamber 39 is decreased to the internal pressure of the fuel tank 1 or the atmospheric pressure so that the fuel pressure regulation valve 35 can be closed, thereby making it possible for the fuel pressure from the fuel pump 10 to be regulated to the high set pressure in the pressure regulation chamber 33 by the urging force of the compression coil spring 36.

The ECU is operative to execute the program stored in the ROM 52 while the sensor information obtained from the sensors 60 as well as the information about the set values and the maps preliminarily stored in the ROM 52 and the backup memory 54 are being delivered to the operation state detection portion 71, the control value calculation portion 72, and the requested set pressure determination portion 73. Under these conditions, the determinations on the load conditions of the engine 20 under cruising operation are repeatedly performed while the partial load operation of the engine 20, viz., the low load operation of the engine (hereinafter simply referred to as "partial operation" covering almost all parts of the operation of the engine 20 after the start of engine is carried out. In this time period, the energization of the three-way electromagnetic valve 41 is stopped while the operation fluid pressure P2 defining the discharge fuel pressure from the fuel pump 10 is introduced into the operation pressure chamber 39 of the case 31 to have the pressure receiving member 37 receive the operation fluid pressure P2 of the operation pressure chamber 39. The operation fluid pressure P2 of the operation pressure chamber 39 causes the pressure receiving member 37 to transmit to the displaceable portion 32*a* the operation force having the fuel pressure regulation valve 35 opened. This leads to the fact that the urging force of the compression coil spring 38 is increased against the urging force of the compression coil spring 36 to lower the set pressure acted on the separation wall member 32 so that the separation wall member 32 can function to regulate the fuel pressure supplied from the fuel pump 10 to the low set pressure in the regulation pressure chamber 33.

The ECU 50 is operative to execute the control program stored in the ROM 52 to determine every predetermined interval whether or not the operation state of the engine 20 is in a state immediately before the engine 10 is transferred to the stopped state on the basis of the sensor information from the sensor group 60, and the set value and the map information preliminarily stored in the ROM 52 and backup memory 54. The three-way electromagnetic valve 41 is then operated to be brought into the energization state in advance of the engine being stopped to have the operation fluid pressure P2 supplied to the operation pressure chamber decreased to the internal pressure of the fuel tank 1 or the atmospheric pressure, so that the fuel pressure regulation valve 36 can be closed to forcibly transfer the pressure of the pressure regulator 30 to the high set pressure by the urging force of the compression coil spring 36 immediately before the engine 10 is transferred to the stopped state.

The ECU 50 is operative to transfer the three-way electromagnetic valve 41 to the deengization state when the time period lapses from the time when the three-way electromagnetic valve 41 is energized prior to the stopped state of the engine 20 to the time when the fuel pump 10 is stopped to have the discharge pressure Pw from the fuel pump 10 decreased to near the internal pressure P3 of the fuel tank 1 or for example to "0" [kPa] (gauge pressure), or otherwise after the waiting time period to the extent taken for the low set pressure lapses, so that the state of the pressure regulator 30 transferred to the high set pressure can stably be maintained even after the deenergization of the three-way electromagnetic valve 41.

For this reason, the set values to be stored in the ROM 51 and the backup memory 53 of the ECU 50 include a high set pressure and a low set pressure, while the information about the maps to be also stored in the ROM 51 and the backup memory 53 includes maps indicative of the determination of the operation load and the changing control of the fuel in response to the result of the determination of the operation load as will be explained hereinafter with reference to FIG. 9.

In this way, the set pressure changing unit 40 is operative to have the set pressure of the pressure regulator 30 in the stopped state of the fuel pump 10 higher than the usual pressure of the pressure regulator 30 in the operation state of the fuel pump 10. Here, the term "usual pressure" is intended to indicate a set pressure at the usual outputting time of the engine 20 accompanying with the fuel consumption of the engine 20 forming the fuel consumption unit or otherwise a set pressure of the pressure regulator 30 at the usual outputting time of the engine 20, viz., a low set pressure. However, the set pressure of the pressure regulator 30 is frequently changed from the low set pressure to the high set pressure if requested while the fuel pump 10 is being operated.

The ECU 50 has not been explained here in detail, but is constructed to perform the known idle stop control to avoid the wasteful idling operation, such as for example, viz., to control the engine 20 to be stopped to reduce the fuel consumption as well as to control exhausted gas to be suppressed after the time of the stopped state of the engine 20 is over a few minutes. In the case that the engine 20 constitutes part of the power unit of the hybrid type including an electric motor, the ECU 50 may be operative to execute the control for the engine 20 to be stopped at an appropriate time when the vehicle is under a low speed cruising.

In the present embodiment, the compression coil spring 36 constitutes a high pressure setting resilient member positioned and compressed between the internal bottom portion 31*e* of the case 31 and the separation wall member 32 in the back pressure chamber 34 and thus functions as the first urging unit defined in the present invention. The compression coil spring 36 has a compression force sufficiently larger than that of the compression coil spring 38 to imparting to the separation wall member 32 the urging force reliably maintaining the closed state of the fuel pressure regulation valve 35 under the condition that the displaceable portion 32*a* of the separation wall member 32 is limited from being moved upwardly in FIG. 1 by the spherical valve body 35*a* and the stem member 35*c* of the fuel pressure regulation valve 35. When, on the other hand, the fuel pressure in the pressure regulation chamber 33 exceeds the high set pressure, the fuel pressure regulation valve 35 is opened to limit the fuel pressure of the fuel from being increased in the regulation chamber 33, thereby making it possible to regulate the fuel pressure to the high set pressure in the regulation chamber 33. The return port 31*d* formed in the case 31 forms an open hole functioning to allow the back pressure chamber 34 to be opened to the exterior space of the case 31 and serving as a passageway allowing the return fuel to be discharged to the fuel tank 1 through the fuel pressure regulation valve 35 at the time of the opened state of the fuel pressure regulation valve 35. According to the present invention, the previously mentioned passageway serving to allow the return fuel to be discharged to the fuel tank 1 through the fuel pressure regulation valve 35 may not be necessarily provided in the back pressure chamber 34.

The operation pressure chamber 39 is positioned in opposing relationship with the back pressure chamber 34 across the pressure regulation chamber 33. The pressure receiving member 37 has one side pressure receiving portion 37*a* positioned in the operation pressure chamber 39 and the other side pressure operation force transmitting portion 37*b* positioned in the pressure regulation chamber 33. According to the present invention, the pressure receiving member 37 may be provided in the back pressure chamber 34 with the separation wall member 32 being imparted the urging force to pull the separation wall member 32 away from the back pressure chamber 34, viz., the urging force to pull the separation wall member 32 in the direction opposite to the direction in which the separation wall member 32 is urged by the compression coil spring 36. The valve body 35*a* of the fuel pressure regulation valve 35 in the form of a roughly spherical shape may be supported on the case 31 in the pressure regulation chamber 33 according to the present invention. The return port allowing the fuel to be discharged from the pressure regulation chamber 33 to the fuel tank 1 in the opened state of the fuel pressure regulation valve 35 may be formed in a cylindrical valve supporting member supported on the case 31 according to the present invention.

Next, the operation will be described hereinafter.

(Engine Stop Operation: Operation Mode A)

The fuel supply apparatus according to the present embodiment as explained in the above description is held in an initial condition under which the engine 20 is stopped with the discharge pressure of the fuel pump 10 being "0" [kPa] and with the three-way electromagnetic valve 41 being deenergized.

At this time, the pressure regulator 30 is held in the condition under which the operation fluid pressure P2, i.e., the discharge fuel pressure from the fuel pump 10 can be introduced into the operation pressure chamber 39 of the case 31. The operation fluid pressure P2 is, however, lowered to the internal pressure P3 of the fuel tank 1, so that the operation pressure chamber 39 has an internal pressure equal to the internal pressure P3 of the fuel tank 1 or the atmospheric pressure P3, and thus the pressure receiving member 37 is positioned at the original position shown in FIGS. 1 and 3. At this time, the fuel pressure regulation valve 35 is therefore held in the closed state. When, under these conditions, the fuel pressurized from the fuel pump 10 is introduced into the pressure regulation chamber 33, the fuel having a regulated high set pressure is maintained in a condition having the fuel instantly supplied to the injector 21. The pressure of the fuel in the pressure regulation chamber 33 is equal to the system pressure P1 at the time of the engine 20 being stopped. The compression coil spring 38 at the time of the pressure receiving member 37 being at the original position has a small urging force. Here, it is assumed that the pressure receiving area of the separation wall member 32 is represented by "S". The urging force acted on the separation wall member 32 from the pressure regulation chamber 33 is indicated by P1×S equal to and thus balanced with the urging force F1 of the compression coil spring 36.

(Engine Initial Operation: Operation Mode B)

When the engine 20 starts to be operated, the ECU 50 is firstly operated to cause the three-way electromagnetic valve 41 to be energized and then to cause the fuel pump 10 to be driven.

Figure 4:
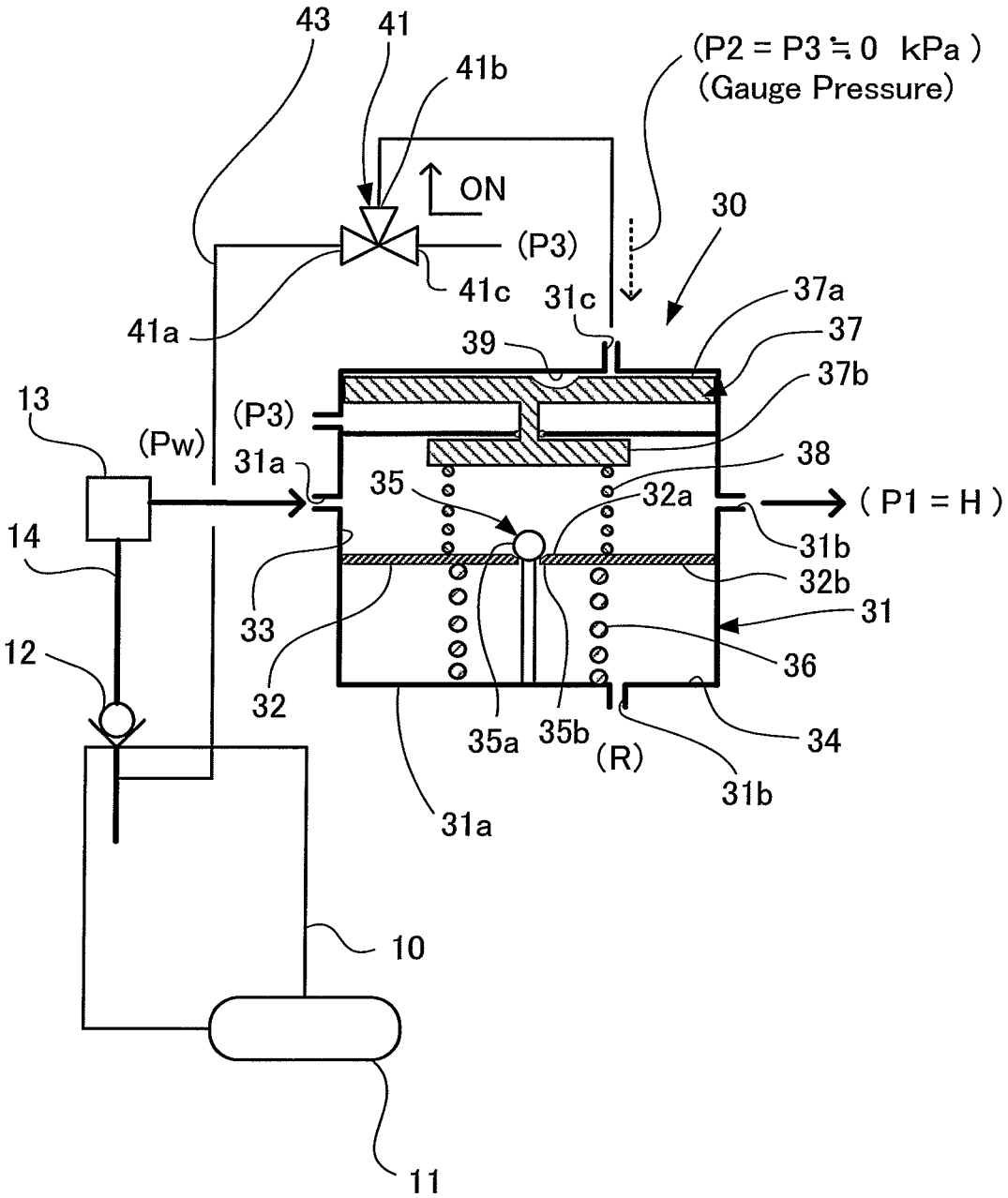
FIG. 4 is a second operation explaining view of the fuel supply apparatus according to one embodiment of the present invention, and showing operation modes at the time of starting the engine and at the time immediately before the stop of the engine.

The discharge pressure of the fuel pump 10 is therefore increased. In this course, the operation fluid pressure P2 is introduced into the operation pressure chamber 39 of the pressure regulator 30 and maintained at the internal pressure P3 of the fuel tank 1. At this time, the fuel pressure regulation valve 35 of the pressure regulator 30 is held in the closed state as shown in FIG. 4. When, under these conditions, the fuel is introduced into the pressure regulation chamber 33 from the fuel pump 10, and the discharge pressure of the fuel pump 10 is increased, the fuel rapidly reaches the high set pressure, for example, 400 [kPa] and is supplied to the delivery pipe 22 through the supply pipe 15 (see FIG. 1) at a system pressure P1, i.e., a high fuel pressure shown by P1=H in FIG. 4. At this time, the fuel pressure of the pressure regulation chamber 33 is maintained equal to the system pressure P1 with the urging force of the compression coil spring 38 being maintained at a small level at the time of the pressure receiving member 37 being positioned at the original position. Therefore, the urging force P1×S acted on the separation wall member 32 from the pressure regulation chamber 33 is equal to and thus balanced with the urging force F1 of the compression coil spring 36 under the high set pressure of the fuel in the pressure regulation chamber 33.

Figure 6:
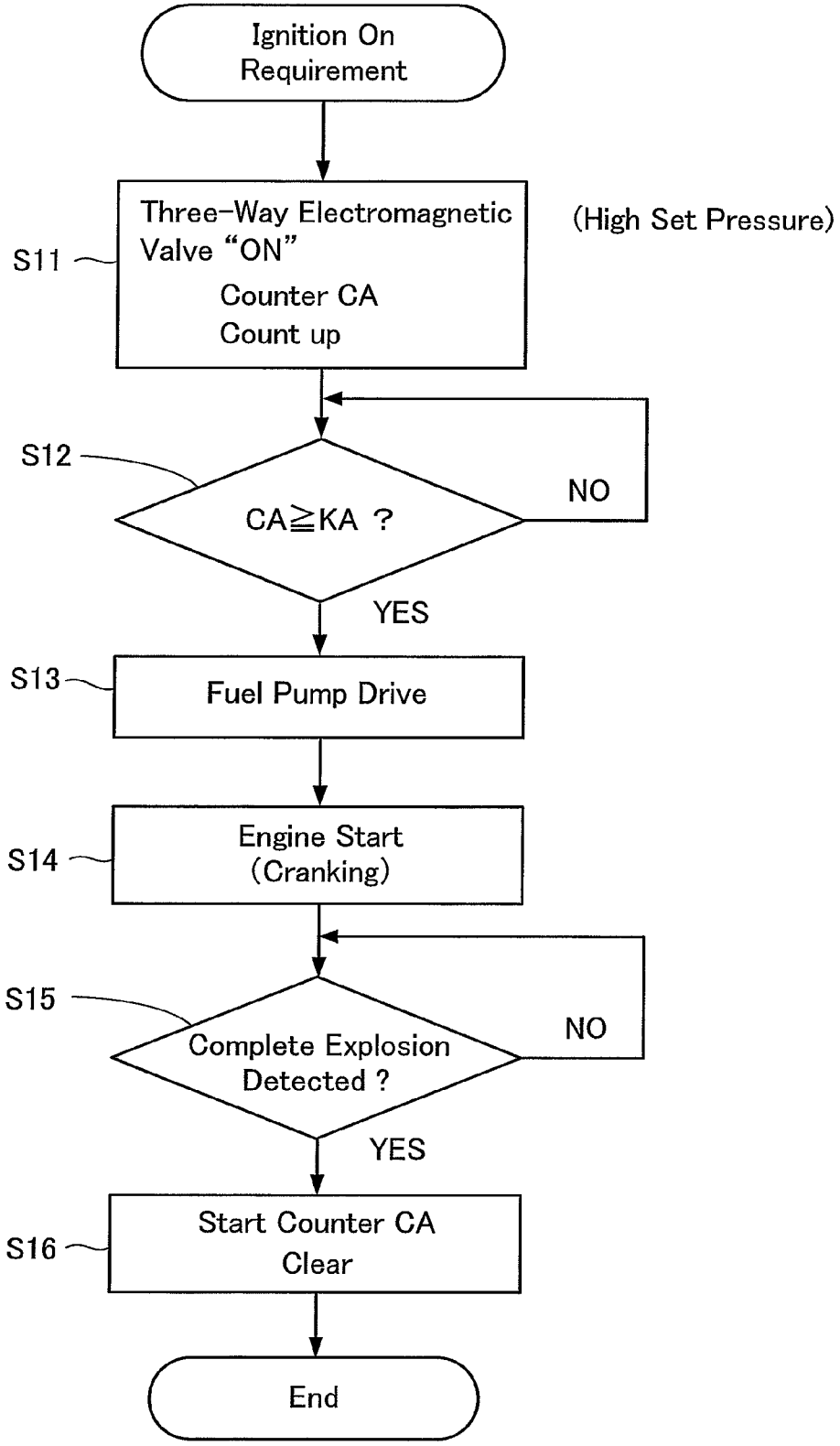
FIG. 6 is a flow chart showing the processing steps of a fuel pressure control program to be executed at the time of starting the engine in the fuel supply apparatus according to one embodiment of the present invention.

More specifically describing about the engine 20 starting with the ECU 50, the ignition key is put on the starting position and then operated to have the ignition switch 44 generate the ignition requirement "ON". At this time, the ECU 50 is operated to execute the fuel pressure control program at the starting time of the engine 20 as shown in FIG. 6.

At the starting time of the engine 20, the three-way electromagnetic valve 41 is temporally energized, and a counter CA is started by the ECU 50 to count up the energization time of the three-way electromagnetic valve 41(Step S11).

The ECU 50 is operated to check whether or not the counted value of the counter CA reaches the energization time KA preliminarily set as the time required for the three-way electromagnetic valve 41 to be switched from the "OFF" state to the "ON" state (Step S12). With the result in this step being "NO" (negative), the energization state, i.e., the "ON" state of the three-way electromagnetic valve 41 is maintained.

When the counted value of the counter CA reaches the energization time KA ("YES" (positive in Step S12), the fuel pump 10 starts to be energized (Step S13). At this time, a starter motor is also energized to get the engine 20 to crank sufficiently to start. (Step S14).

The energization of the fuel pump 10 is ON/Off controlled in response to the operation state of the engine 20. Or otherwise, in addition to the above control of the fuel pump 10, the control to variably control the discharge amount of the fuel pump 10 is executed.

The ECU 50 is then operated to repeatedly determine every predetermined time whether or not the cranking operation of the engine 20 is successfully completed depending upon whether the engine 20 reaches to a predetermined cranking completion rotation speed indicative of the engine 20 being in the complete explosion state (Step S15). With the result in this step being "NO" (Step S15), the crancking of the engine 20 continues.

When the engine 20 then reaches the cranking completion rotation speed ("YES" in Step 15), the ECU 50 is operated to detect the cranking operation completion state of the engine 20 and clear the counter CA to finish the fuel pressure control program for the current cranking operation of the engine 20.

(Partial Load Operation: Operation Mode C)

After the cranking operation of the engine 20, the engine 20 usually enters the partial load operation state, i.e., half throttle operation state in which the engine 20 is operated exclusively under the half throttle, except for the requested high load operation in which the engine 20 is required to be specially operated at a high fuel pressure. At the time of the engine 20 operated under the half throttle operation state, the engine 20 is required to be operated at the low set pressure in view of the fuel consumption and the pump reliability.

Figure 5:
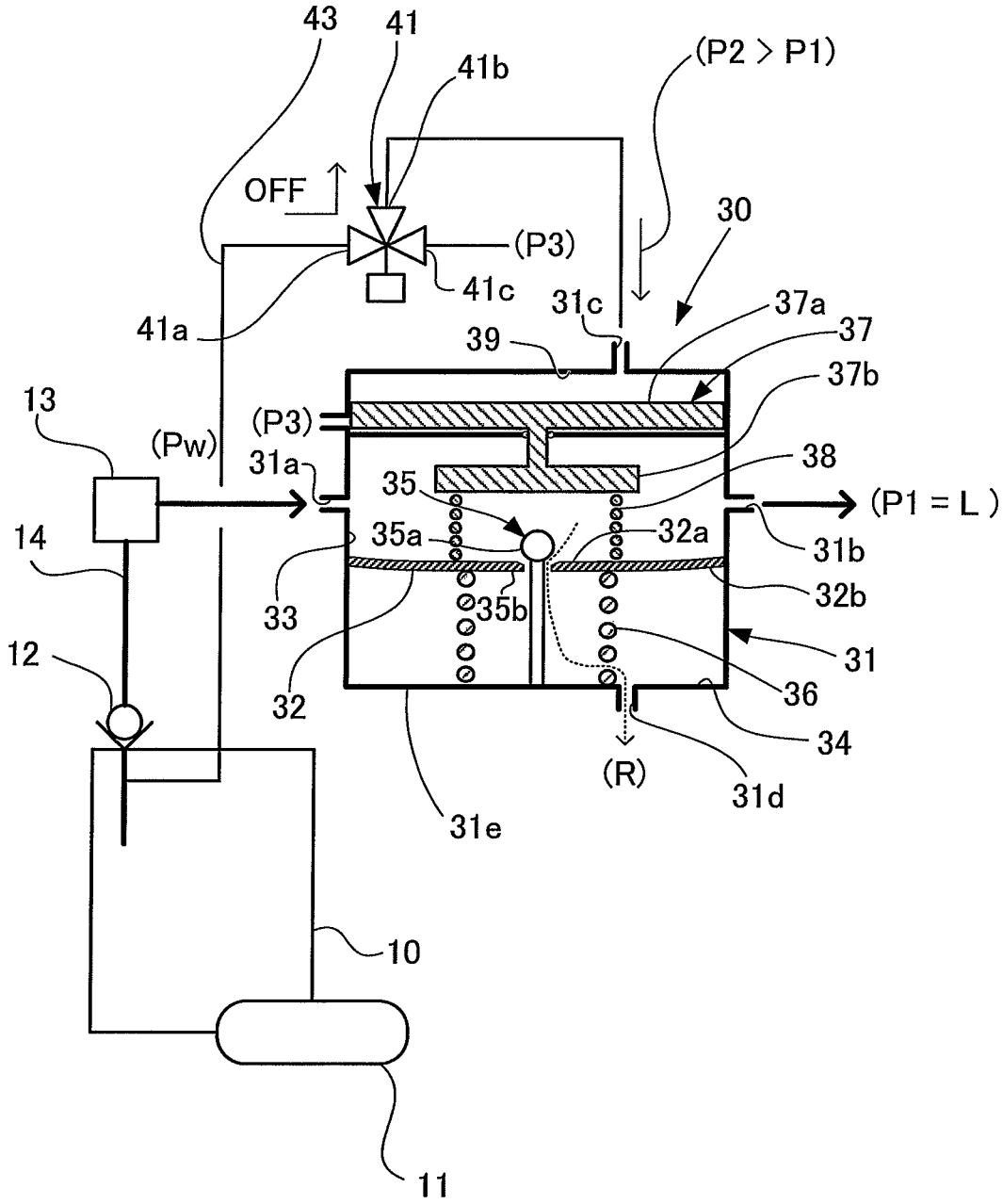
FIG. 5 is a third operation explaining view of the fuel supply apparatus according to one embodiment of the present invention, and showing an operation mode at the time of the engine with a partial load.

In the partial load operation state of the engine 20, the ECU 50 is operated to have the energization of three-way electromagnetic valve 41 stopped and to have the operation of the fuel pump 10 continue as shown in FIG. 5.

Figure 9:
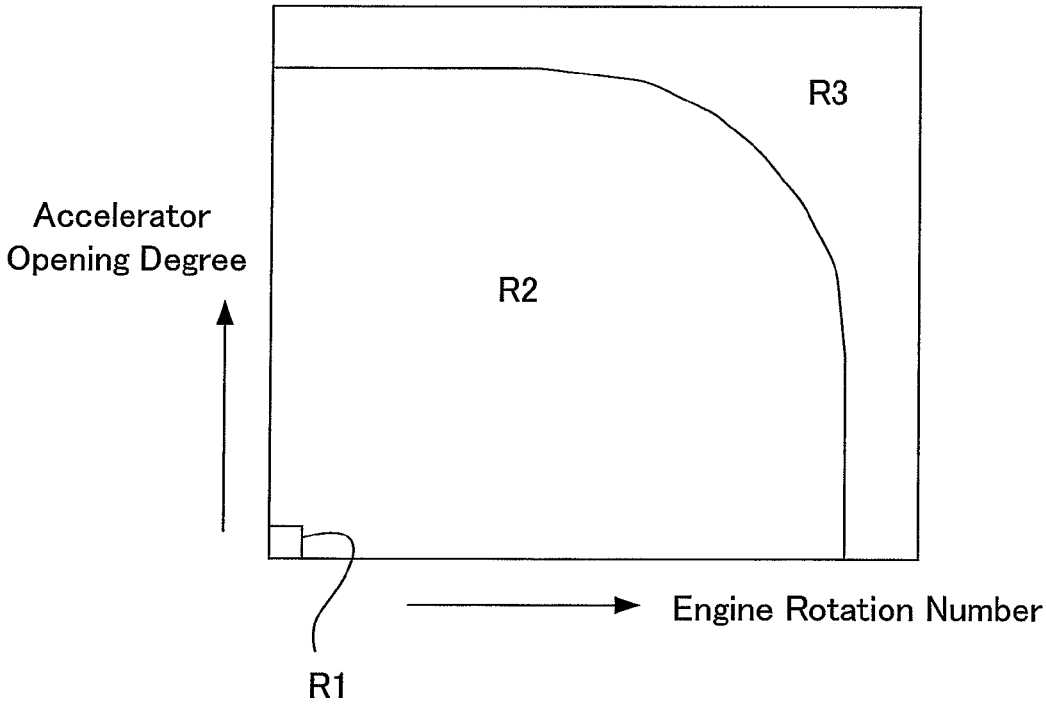
FIG. 9 is an explanation view showing a partial load operation area of the engine equipped with the fuel supply apparatus according to one embodiment of the present invention.
Figure 10:
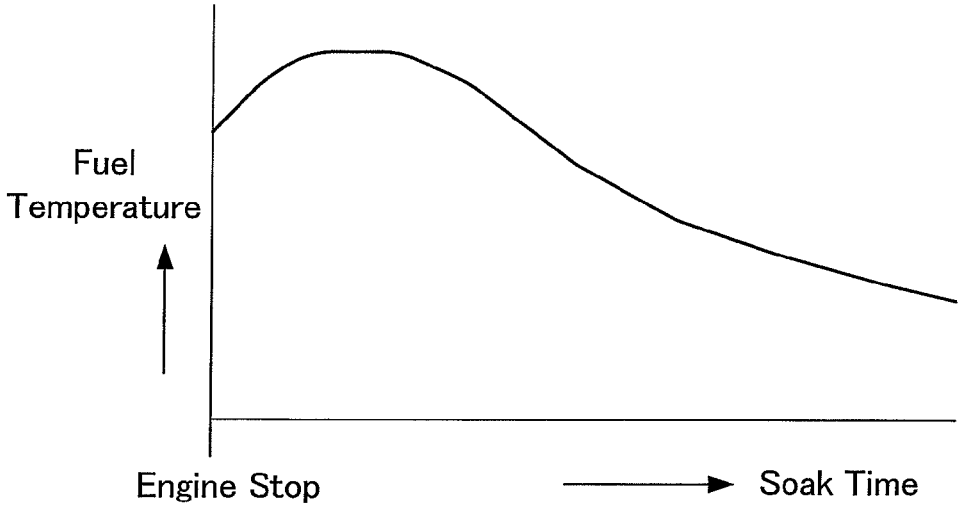
FIG. 10 is a graph showing a fuel temperature fluctuation in a delivery pipe immediately after the stop of the engine equipped with the fuel supply apparatus according to one embodiment of the present invention.

More concretely, the ECU 50 in the operation state of the engine 20 is operated to specify the operation state requested to the engine 20 and to determine whether the specified operation state is included in the high load operation area R3 shown in FIG. 9 or in the partial load operation area R2 shown in FIG. 9 on the basis of the information obtained by the various sensors about the operation state such as the rotation speed of the engine 20, the speed of the vehicle, and the like, and the operation position of the accelerator pedal operated by a driver. In the case that the operation state requested to the engine 20 is included in the partial load operation area R2, the relay switches 24, 25 for energization control use are controlled to have the energization of the three-way electromagnetic valve 41 stopped and to have the energization of the fuel pump 10 continue. In FIG. 9, the operation area at the starting time of the engine 20 is represented by the reference legend "R1".

As shown in FIG. 5, the operation fluid pressure P2 introduced into the operation pressure chamber 39 of the pressure regulator 30 in the partial load operation state of the engine 20 is equal to the discharge pressure of the fuel pump 10 before having the fuel pressure regulated by the pressure regulator 30, so that the operation fluid pressure P2 is higher than the fuel pressure after regulated by the pressure regulator 30, i.e., the system pressure P1. With the operation fluid pressure P2 being introduced into the operation pressure chamber 39, the pressure receiving member 37 receives the operation fluid pressure P2 of the operation pressure chamber 39 to transmit the operation force to the displaceable portion 32*a* of the separation wall member 32 in the direction having the fuel pressure regulation valve 35 opened. This means that the fuel pressure discharged from the fuel pump 10 is regulated in the pressure regulation chamber 33 to the low set pressure, for example, 200 [kPa] which is then supplied to the delivery pipe 22 through the supply pipe 15 as the low fuel pressure, i.e., the system pressure P1 (represented by the reference legend P1=L in FIG. 5). At this time, the fuel pressure in the pressure regulation chamber 33 is equal to the system pressure P1, and the pressure receiving member 37 receives the operation fluid pressure to have the urging force F2 of the compression coil spring 38 come to be large, so that the urging force P1 acted on the separation wall member 32 from the pressure regulation chamber 33 is equal to the addition of P1×S and the urging force F2 of the compression coil spring 38. The added urging force (P1×S+F2) is balanced with the urging force F1 of the compression coil spring 36 under the low set pressure of the fuel in the pressure regulation chamber 33. This means that the equation P1×S=F1−F2=400×S−200×S=200×S. The fuel in the pressure regulation chamber 33 is thus held in a pressure-regulated state at the low set pressure of 200 [kPa].

Figure 7:
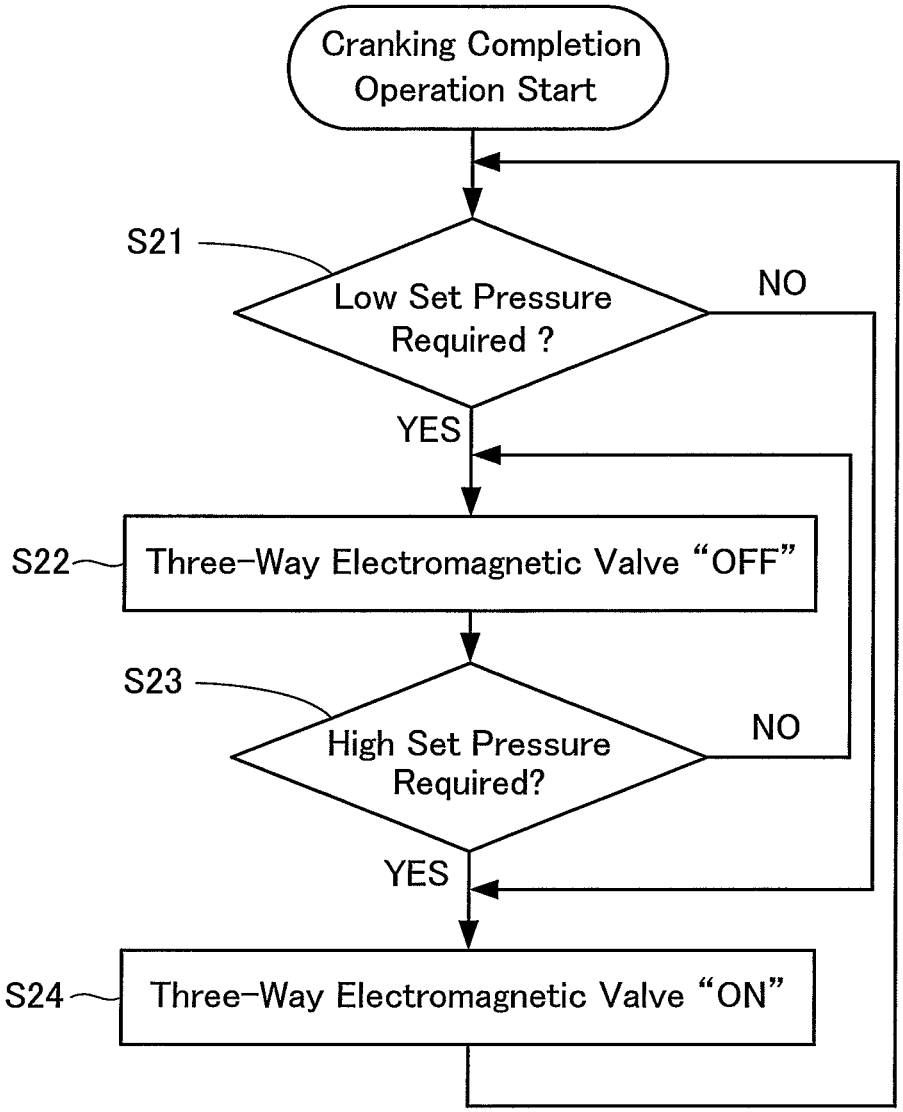
FIG. 7 is a flow chart showing the steps of a fuel pressure control program to be executed during the operation of the engine in the fuel supply apparatus according to one embodiment of the present invention.

More concretely, the ECU 50 is operated to execute the fuel pressure control program for the operation of the engine 20 shown in FIG. 7 after the cranking operation completion of the engine 20 is detected.

The above fuel pressure control program for the operation of the engine 20 is executed by the ECU 50 to judge whether the low set pressure is required or not (Step S21). With the judged result being "YES", the energization of the three-way electromagnetic valve 41 is stopped, and thus comes to be in the "OFF" state (Step S22).

The fuel pressure control program is then executed by the ECU 50 to judge whether the high set pressure is required or not (Step S23). With the judged result being "No", the step is returned to the immediate prior state in which the energization of the three-way electromagnetic valve 41 is maintained to be stopped, and thus the three-way electromagnetic valve 41 continues to be in the "OFF" state (Step S22).

On the other hand, with the judged result being "YES" ("YES" in Step S23), the three-way electromagnetic valve 41 is energized, and thus brought into the "ON" state (Step S24). Thereafter, the fuel pressure control program is executed by the ECU 50 to have the step returned to the initial step in which the process of the ON/OFF changing control of the three-way electromagnetic valve 41 begins to be executed again. Further, the fuel pressure control program for the operation of the engine 20 is executed only in the state in which the ignition OFF to be hereinafter described in detail is not required. The above fuel pressure control program for the operation of the engine 20 may be executed by the ECU 50 to have the three-way electromagnetic valve 41 subject to the interrupt handling for controlling ON/OFF in response to the requested fuel pressure only when the changing request for the fuel pressure is generated after the cranking operation completion of the engine 20.

(High Load Operation: Operation Mode B)

To be "YES" for the judged result of whether the high set pressure is requested or not is a case that the operation state for the engine 20 to be requested enters the high load operation area R3 shown in FIG. 9 in response to the operation input from the driver driving the vehicle and the cruising environment change of the vehicle. In this case, the ECU 50 is operated to energize the three-way electromagnetic valve 41, and to continue the operation of the fuel pump 10.

At this time, similarly to the cranking operation as shown in FIG. 4, the operation fluid pressure P2 introduced into the operation pressure chamber 39 of the pressure regulator 30 is temporally lowered to the internal pressure of the fuel tank 1 or to the atmospheric pressure to have the fuel pressure regulation valve 35 returned to the closed state, so that the fuel from the fuel pump 10 comes to be adjusted to the high set pressure in the pressure regulation chamber 33.

(Engine Stop Prior Operation: Operation Mode B)

For stopping the engine 20, the ignition key is for example operated by the driver to be brought into the state "OFF". In this case, the ECU 50 is operated to have the three-way electromagnetic valve 41 energized immediately prior to the stop of the engine 20, viz., immediately in advance of the stop of the engine 20.

At this time, the operation fluid pressure P2 is therefore lowered to the internal pressure of the fuel tank 1 or to the atmospheric pressure irrespective of the immediately prior operation state of the pressure regulator 30, so that the set pressure of the pressure regulator 30 is forced to be transferred to the high set pressure.

Figure 8:
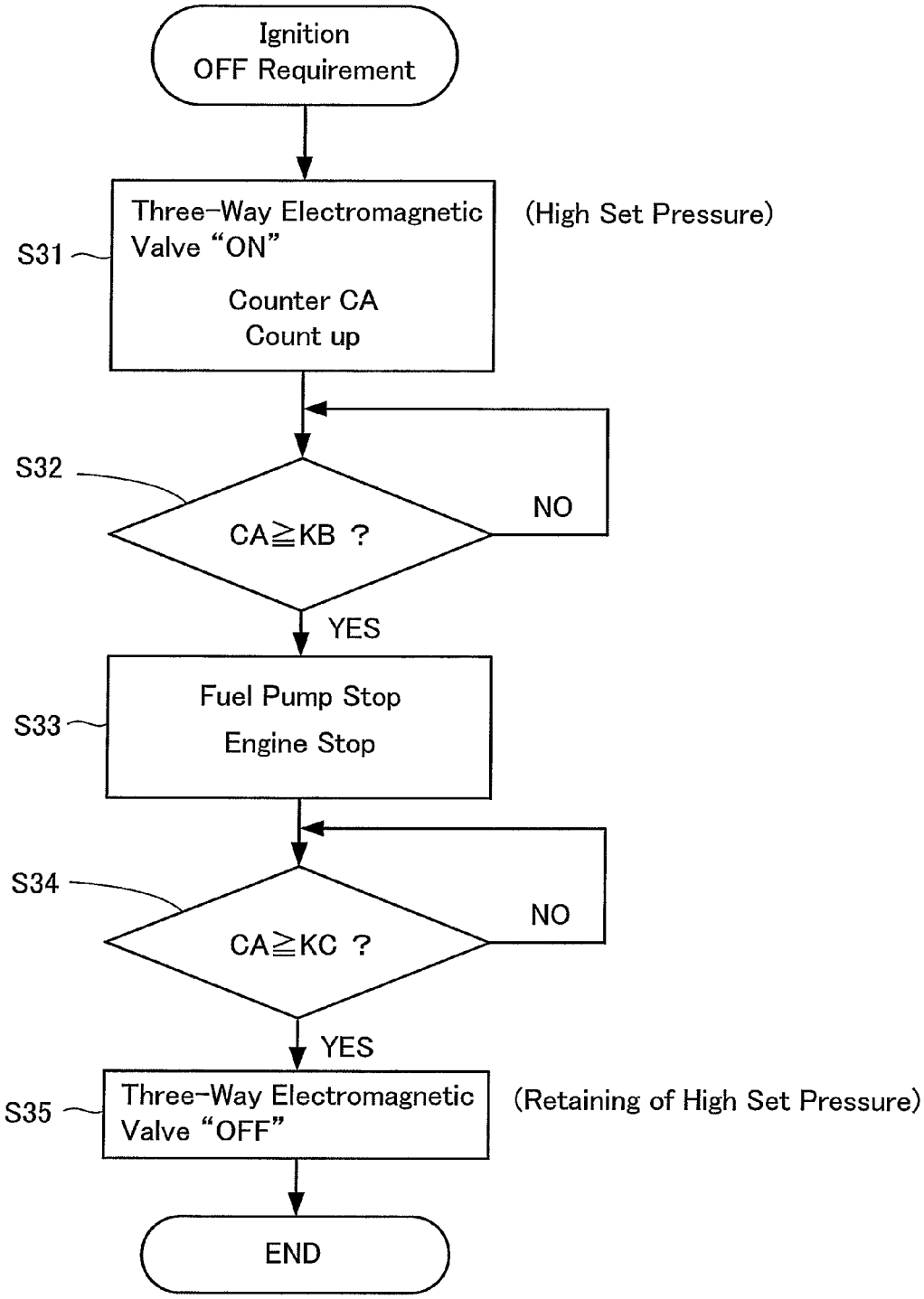
FIG. 8 is a flow chart showing the processing steps of a fuel pressure control program to be executed at the time of stopping the engine in the fuel supply apparatus according to one embodiment of the present invention.

More concretely, the ECU 50 is operated to start the fuel pressure control program as shown in FIG. 8 when the ignition "OFF" state to stop the engine 20 is requested.

In the fuel pressure control program at the time of the stop of the engine 20, the energization of the three-way electromagnetic valve 41 is firstly executed to have the three-way electromagnetic valve 41 brought into the "ON" state and to have the counter CA count up the energization time (Step S31).

In the fuel pressure control program, the check is then conducted on whether or not the count value of the counter CA reaches the energization time KB, immediately before the stop of the engine 20, preliminarily set as the time required for changing the set pressure to the high set pressure by energizing the three-way electromagnetic valve 41 (Step S32). With the result being "NO", the energization state (ON state) of the three-way electromagnetic valve 41 is maintained. Here, the energization time KB is near or approximately equal to a time required to almost completely discharge the fuel from the operation pressure chamber 39 in response to the return to the initial position of the pressure receiving member 37 when the three-way electromagnetic valve 41 is energized to change the set pressure to the high set pressure.

When the count value of the counter CA then reaches the energization time KB ("YES" in Step S32), the energization to the fuel pump 10 is stopped on condition that the three-way electromagnetic valve 41 is maintained in the energized high set pressure state, and the process required for stopping the engine 20 is executed (Step S33).

In the fuel pressure control program, the check is then conducted on whether or not the count value of the counter CA reaches the time KC required for the discharge pressure of the fuel pump 10 to be lowered to the pressure degree equal to the internal pressure of the fuel tank 1 or the atmospheric pressure (Step S34). With the result being "NO", the energization to the three-way electromagnetic valve 41 is maintained. Here, the energization time KC can be sensed from the count value further counted up after the count value of the counter CA reaches the end of the count of the energization time KC, or can be sensed from the count value starting the count-up at the time of the energization of the fuel pump 10 being stopped.

When the count value of the counter CA then reaches the energization time KC ("YES" in Step S34), the discharge pressure Pw of the fuel pump 10 is maintained to sufficiently be lowered to the internal pressure of the fuel tank 1 or the atmospheric pressure, in which the energization to the three-way electromagnetic valve 41 is stopped, and thus the three-way electromagnetic valve 41 comes to be in the OFF state, thereby finishing the fuel pressure control program at the current time of the stop of the engine 20.

(Engine Stop Operation: Operation Mode A)

The fuel pressure control immediately before the stop of the engine 20 as previously mentioned is carried out with the fuel pump 10 being stopped from being energized, while maintaining the energization of the three-way electromagnetic valve 41 in advance of the stop of the engine 20. When the discharge pressure Pw of the fuel pump 10 is then lowered to the pressure level near the internal pressure P3 in the fuel tank 1, or otherwise the waiting time required for reaching the above pressure level lapses, the three-way electromagnetic valve 41 is changed into the OFF state (deenergization).

Figure 3:
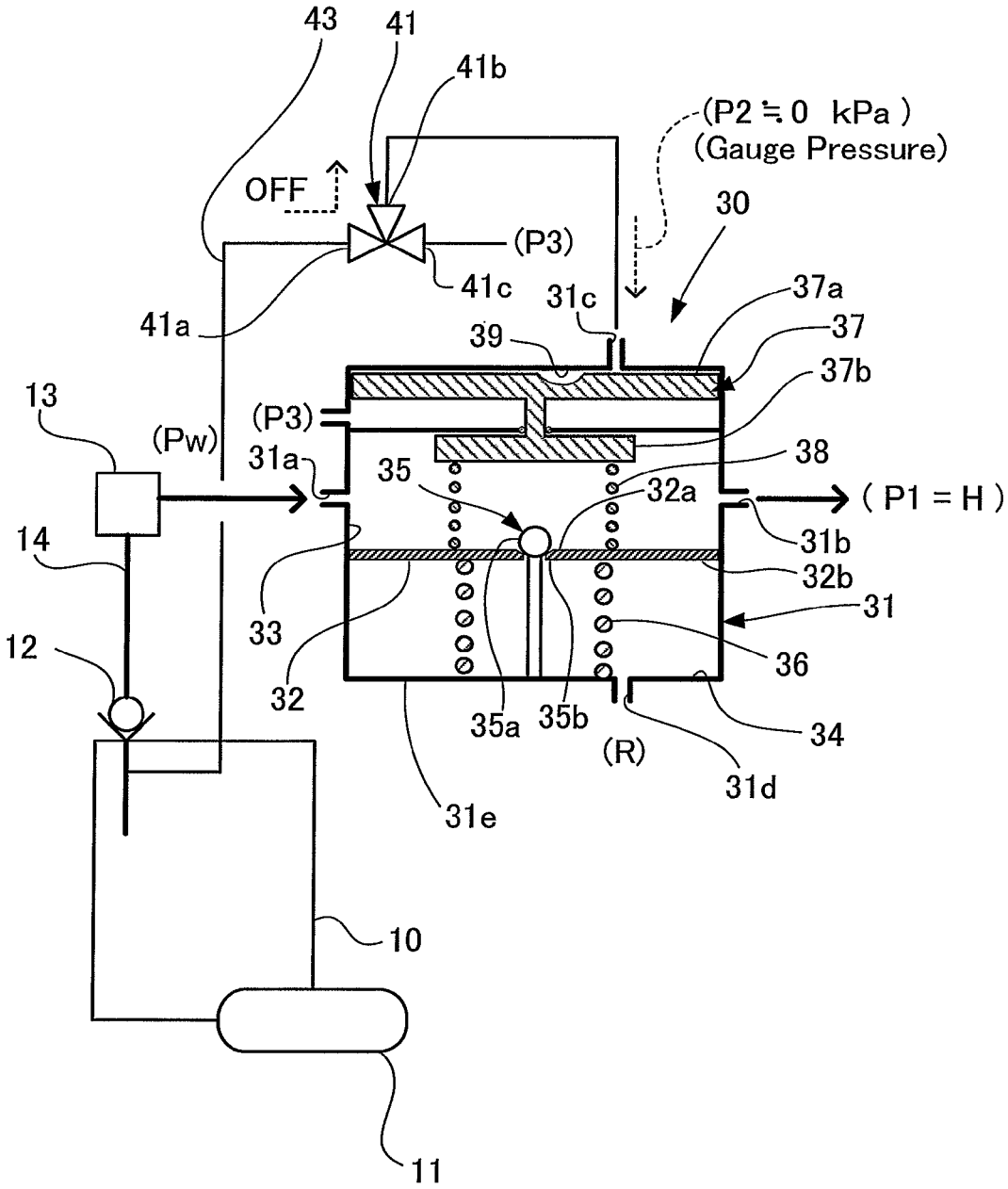
FIG. 3 is a first operation explaining view of the fuel supply apparatus according to one embodiment of the present invention, and showing operation modes during the stop of the engine and at the time of stopping the engine.

When the three-way electromagnetic valve 41 is changed into the OFF state as previously mentioned, the pressure regulator 30 is held in the state introducing the operation fluid pressure P2, viz., the discharge fuel pressure from the fuel pump 10 into the operation pressure chamber 39 in the case 31 while the operation fluid pressure P2 is lowered to the pressure degree equal to the internal pressure P3 of the fuel tank 1 immediately before the stop of the engine 20. This situation leads to the fact that the pressure receiving member 37 is maintained to be stopped at the initial position as shown in FIGS. 1 and 3. At this time, the fuel pressure regulation valve 35 is therefore maintained in the closed state, the fuel supply passageway from the check valve 12 positioned at the discharge side of the fuel pump 10 to the injector 21 is maintained at the high set pressure, and the engine 20 is maintained to be stopped. When the engine 20 starts to be operated again, the pressure regulator 30 is held in the state having the high set pressure regulatable, so that when the fuel pressure from the fuel pump 10 is introduced into the pressure regulation chamber 33, the fuel can be immediately regulated to the high set pressure.

(Operation)

As will be understood from the foregoing description, the fuel supply apparatus according to the present embodiment can secure a high fuel pressure since the set pressure of the pressure regulator 30 is in the high set pressure state at the time of the engine 20 being stopped, and thus the fuel supply can be immediately carried out with a sufficient fuel pressure when the fuel pump 10 is operated with the start of the engine 20. This leads to preventing the fuel vapor from being generated in the fuel supply passageway at the starting time of the engine 20, thereby making it possible to enhance the starting operation property of the engine 20.

The present embodiment is constructed to have the pressure regulator 30 operated with the operation fluid pressure P2 being introduced into the operation pressure chamber 39, but to have the fuel from the fuel pump 10 regulated in pressure in such a manner that the fuel from the fuel pump 10 is regulated to the high set pressure when the operation fluid pressure P2 is lowered, while the fuel from the fuel pump 10 is regulated to the low set pressure when the operation fluid pressure P2 is increased. This means that the pressure of the fuel from the fuel pump 10 can easily be set to the high set pressure when the fuel pump 10 is stopped, thereby resulting in no need for power to increase the operation fluid pressure P2 for the purpose of increasing the pressure of the fuel from the fuel pump 10 at the starting time of the engine 20, and thereby making it possible to stably secure the high set pressure of the fuel pressure in the state of the operation fluid pressure P2 being lowered. In addition, the urging force to the separation wall member 32 from the pressure receiving member 37 can be stably supplied, and the fuel pressure of the low set pressure can be stably secured when the operation fluid pressure P2 is raised.

Further, the fuel supply apparatus according to the present embodiment is operated to have the set pressure changing unit 40 lower the operation fluid pressure P2 in advance of the stop of the engine 20, and to have the set pressure of the pressure regulator 30 transferred to the high set pressure, so that when the engine 20 is stopped, the timing of lowering the operation fluid pressure P2 is simply adjusted, thereby making it possible to have the set pressure of the pressure regulator 30 brought into the high state on the way to the stop of the engine 20. It will therefore be understood that when the fuel pump 10 is operated for the starting operation or the high temperature repeated starting operation of the engine 20, the fuel supply can be immediately started at the sufficient fuel pressure, thereby making it possible to secure the high fuel pressure at the starting time of the engine 20.

Especially at the high temperature repeated starting operation, as shown in FIG.

10, immediately after the stop of the engine 20, the engine 20 is stopped from being cooled by cooling water and wind, thereby leading to the temperature of the fuel raised in the fuel supply passageway in the delivery pipe 22, and thus to making it for the fuel vapor to be easily generated. According to the present embodiment, however, the fuel supply can be immediately started with the sufficient fuel pressure, thereby securing an excellent starting operation property when the high temperature repeated starting operation of the engine 20 starts with the starting operation of the fuel pump 10.

Further, the present embodiment is constructed to get the set pressure changing unit 40 to bring the operation fluid pressure P2 to the internal pressure P3 (atmospheric pressure level) of the fuel tank 1 before the operation of the fuel pump 10, thereby imparting no unnecessary load to the engine 20 for obtaining the operation fluid pressure P2 at the time of the starting operation or the high temperature repeated starting operation of the engine 20 since the set pressure of the pressure regulator 30 is transferred to the high set pressure. Further, when the set pressure of the pressure regulator 30 is transferred to the low set pressure, the set pressure changing unit 40 is operated to supply the operation fluid pressure P2 to the pressure regulator 30 based on the pressure of the fuel discharged from the fuel pump 10, thereby making it unnecessary to provide a pressure source to be exclusively used for producing the operation fluid pressure P2.

Moreover, the present embodiment is constructed to have the check valve 12 provided between fuel pump 10 and the pressure regulator 30, so that the set pressure changing unit 40 is operated to have the operation fluid pressure P2 supplied to the pressure regulator 30 based on the pressure of the fuel upstream of the check valve 12 when the set pressure of the pressure regulator 30 is transferred to the low set pressure. This results in the fact that the check valve 12 is operated to check the fuel reversed in a backward direction from the injector 21 to the fuel pump 10, effectively maintaining the predetermined pressure of the fuel in the fuel supply passageway, and making it possible for the operation fluid pressure P2 to promptly be raised at the starting operation of the fuel pump 10.

The set pressure changing unit 40 is constituted to include an electromagnetic valve, i.e., the three-way electromagnetic valve 41 for supplying the pressure of the fuel discharged from the fuel pump 10 as the operation fluid pressure P2 to the pressure regulator 30 at the time of the deenergization of the set pressure changing unit 40, so that the three-way electromagnetic valve 41 can be in the deenergization state during the normal operation of the engine 20 having the fuel from the fuel pump 10 regulated exclusively to the low set pressure, thereby making it possible to respond the requirements in the recent years for low fuel consumption and for saving power to the vehicle. Further, at the time of the energization of the three-way electromagnetic valve 41, the second port 41*b* can be opened to the inside of the fuel tank 1 or the atmospheric pressure space, thereby making it possible to carry out the reliable set pressure change in the saved power state.

Additionally, the present embodiment is constructed to have the fuel pressure regulation valve 35 urged in the closing direction in response to the urging force of the compression coil spring 36 to be used for setting the high pressure, thereby stably securing the fuel pressure of the high set pressure when the operation fluid pressure P2 is lowered to the atmospheric pressure level, and, on the other hands, to have the fuel pressure regulation valve 35 urged in the opening direction in response to the urging force of the compression coil spring 38 to be used for reducing the low pressure, thereby stably securing the fuel pressure of the low set pressure when the operation fluid pressure P2 is raised to the discharge pressure level of the fuel pump 10. Therefore, the set pressure of the fuel pressure caused by the change of the operation fluid pressure P2 can stably be changed. In addition, the fuel pressure regulation valve 35 constructed to be opened and closed in response to the displacement of the displaceable portion 32*a* of the separation wall member 32 in the pressure regulation chamber 33 makes it possible to more stably change the set pressure.

The present embodiment is constructed to have the pressure receiving member 37 generate the mechanical urging force in an opposite urging direction with respect to the urging force of the compression coil spring 36, so that the set pressure can be set at the high set pressure at the time of the operation fluid pressure being lowered, and the freedom degree in the disposition of the pressure receiving member 37 can be enhanced.

The present embodiment is constructed to have the compression coil spring 38 disposed between the pressure receiving member 37 and the displaceable portion 32*a* of the separation wall member 32 to be used for reducing pressure and to transmit the operation force from the pressure receiving member 37 to the displaceable portion 32*a* in the opening direction of the fuel pressure regulation valve 35, so that it is possible to have the operation force transmitted to the displaceable portion 32*a* from the pressure receiving member 37, and to have the pressure receiving member 37 returned to the original position by the reaction force of the compression coil spring 38 at the time of the operation fluid pressure P2 being lowered, thereby making it possible for the set pressure changing unit 40 to be simple in construction.

The present embodiment is constructed to have the operation pressure chamber 39 positioned in opposing relationship with the back pressure chamber 34 across the pressure regulation chamber 33, and to have the pressure receiving member 37 have a pressure receiving portion 37*a* positioned in the operation pressure chamber 39, and an operation force transmitting portion 37*b* positioned in the pressure regulation chamber 33, so that the urging force of the pressure reducing compression coil spring 38 can be in an opposite direction to the urging force of the high pressure setting compression coil spring 36, while the second urging unit (urging unit to be used for reducing the pressure) exemplified by the pressure reducing compression coil spring 38 can be disposed with a high degree of freedom, thereby enabling a reliable operation force transmission in response to the operation fluid pressure P2.

For generating the urging force in the high pressure setting direction, the high pressure setting compression coil spring 36 is positioned and compressed between the internal bottom portion 31*e* of the case 31 and the separation wall member 32 in the back pressure chamber 34, and the case 31 is formed with the return port 31*d* allowing the back pressure chamber 34 to be opened to the space outside of the case 31, so that the first urging unit for generating the urging force in the high pressure setting direction is simple in construction enabling to stably secure the high set pressure at the stable back pressure.

As will be understood from the foregoing description, the present embodiment is constructed to have the set pressure of the pressure regulator 30 increased when the fuel pump 10 is stopped, while the fuel pump 10 is operated and then the fuel supply to the injector 21 is immediately started at the sufficient fuel pressure to secure the high fuel pressure when the engine 20 is started, so that the fuel vapor can be prevented from being generated at the starting operation of the engine 20, thereby making it possible to enhance the starting operation property.

Furthermore, the pressure regulator 30 is constructed to be operated by the operation fluid pressure P2 introduced therein to have the fuel pressure from the fuel pump 10 regulated to the high set pressure when the operation fluid pressure P2 is lowered, so that the set pressure can easily be set at the high pressure at the time of the stop of the fuel pump 20. It is therefore possible to make it unnecessary for the power to increase the operation fluid pressure P2 for the purpose of heightening the set pressure at the time of starting the engine 20 as well as to stably secure the high set pressure of the fuel in the state of the operation fluid pressure P2 being lowered. Stably securing the low set pressure of the fuel in the normal operation of the engine 20 in the state of the operation fluid pressure P2 being raised, ensures that the load of the fuel pump 10 is prevented from being increased.

It may consider that as seen in the case of a conventional apparatus an electromagnetic valve for increasing the back pressure of the pressure regulator is used to retain the high fuel pressure in the pressure regulator with the energization of the electromagnetic valve at the time of the engine 20 being stopped, but the above case leads to introducing the decrease of the voltage of a battery during the stop of the vehicle. Further, it may be possible to introduce the negative pressure of suction air into the back pressure of the pressure regulator, however, this case encounters such a problem that the negative pressure of suction air is increased at the time of starting the engine 20, and thus fuel pressure is lowered, thereby resulting in easily generating fuel vapor, and thus leading to a rough idle as it is called. It is therefore difficult in both of the above cases to provide a fuel supply apparatus which can secure the high fuel pressure and enhance the starting operation property at the time of starting the fuel consumption unit such as an internal combustion engine and the like, and can respond the requirements for low fuel consumption and for saving power.

Although the above present embodiment has been explained about the case in which the ECU 50 is operated to execute the fuel pressure control program for starting the engine 20 when the ignition key is operated at the starting position to generate the ignition key request "ON", the present invention may be applied to the following two cases. One of the cases is that the engine 20 to be mounted on the vehicle executing a known idling stop is temporally stopped and then restarted again, while the other of the cases is that the engine 20 to be mounted on the vehicle having a power unit of a hybrid type is temporally stopped and then restarted again to enhance the efficiency of the power unit. At the time of generating the ignition key request "ON" for restarting the engine 20, the processes like the steps S11 to S16 can of course be executed.

Further, the ECU 50 has been explained in the above present embodiment to be operated to bring the three-way electromagnetic valve 41 into the energization state immediately before the stop of the engine 20 when the key switch is operated for example by the driver to the ignition "OFF" side, however, the present invention may be applied to the following two cases. One of the cases is that the engine 20 to be mounted on the vehicle executing a known idling stop is temporally stopped and then restarted again, while the other of the cases is that the engine 20 to be mounted on the vehicle having a power unit of a hybrid type is temporally stopped and then restarted again to enhance the efficiency of the power unit. At the time of generating the ignition key request "OFF" for restarting the engine 20, the processes like the steps S31 to S35 can be executed.

The fuel pressure regulation valve 35 has been explained in the above present embodiment to be constructed to have a valve body 35*a* in the form of a roughly spherical shape, and an annular valve seat 35*b* enabling the spherical valve body 35*a* to be seated thereon, however, the valve body 35*a* may be in the form of a flat and annular plate shape other than the form of the roughly spherical shape, and the valve seat surface of the annular valve seat 35*b* may not be required to be in the form of a conical shape. This means that the valve structure of the fuel pressure regulation valve 35 is not limited to the special construction, and thus any type of regulation valve known in the art can be utilized.

Further, the above present embodiment is constructed to have the fuel consumption unit constituted by a gasoline engine to be used for a vehicle consuming gasoline, but may be applicable to another engine using another fuel other than the above engine of the vehicle. The present invention is applicable to various kinds of fuel consumption unit, operative to consume fuel and to output power, and operative to change the fuel pressure between the high and low set pressures.

As will be understood from the foregoing description, the fuel supply apparatus according to the present invention is constructed to have the set pressure of the pressure regulator brought into the high pressure state at the time of the fuel pump being stopped, and thus to secure the high fuel pressure by starting the fuel supply at a sufficient fuel pressure level immediately when the fuel pump is operated for starting the fuel consumption unit. The present invention can provide a fuel supply apparatus which is adapted to prevent the fuel vapor and to enhance the starting operation property of the fuel consumption unit at the time of starting the operation of the fuel consumption unit such as an internal combustion engine and the like. The present invention is useful for a general fuel supply apparatus suitable for an internal combustion engine of a vehicle which is operative to allow the fuel stored in the fuel tank to be supplied to the fuel consumption unit by the fuel pump, and to regulate the supply pressure to the fuel consumption unit with the pressure regulator.

EXPLANATION OF REFERENCE NUMERALS

1 fuel tank
10 fuel pump
12 check valve
20 engine (internal combustion engine, fuel consumption unit)
21 injector (fuel injection unit)
30 pressure regulator
31 case
31*d* return port (open hole)
31*e* internal bottom portion
32 separation wall member
32*a* displaceable portion
33 pressure regulation chamber
34 back pressure chamber
35 fuel pressure regulation valve
36 compression coil spring for setting high pressure (first urging unit, resilient member to be used for setting the high set pressure)
37 pressure receiving member
37*a* pressure receiving portion
37*b* operation force transmitting portion
38 compression coil spring
39 operation pressure chamber
40 set pressure changing unit
41 three-way electromagnetic valve (electromagnetic valve, set pressure changing unit)
41*a* first port
41*b* second port
41*c* third port
50 ECU (set pressure changing unit)
60 sensor group
73 requested set pressure determination portion
83 set pressure change signal output portion
84 pump control signal output portion
P1 system pressure (fuel pressure after pressure regulation)
P2 operation fluid pressure (operation fluid pressure)
R1 operation area
R2 partial load operation area
R3 high load operation area

The invention claimed is:

1. A fuel supply apparatus, comprising:

a fuel pump for supplying fuel reserved in a fuel tank to a fuel consumption unit;

a pressure regulator for introducing therein the fuel to be supplied to the fuel consumption unit from the fuel pump and regulating the fuel to a set pressure, the pressure regulator being operative to change the set pressure of the fuel to a high set pressure and a low set pressure; and a set pressure changing unit for changing and controlling the set pressure of the pressure regulator into a desired set pressure selected from among the high set pressure and the low set pressure;

the pressure regulator being operative by an operation fluid pressure to be introduced therein to regulate the fuel from the fuel pump to the high set pressure when the operation fluid pressure is lowered;

the set pressure changing unit being operative to supply the operation fluid pressure to the pressure regulator based on the pressure of the fuel to be discharged from the fuel pump, and to allow the set pressure of the pressure regulator at the time of the fuel pump being stopped to be higher than the set pressure of the pressure regulator at the time of the fuel pump being operated.

2. The fuel supply apparatus as set forth in claim 1, in which the pressure regulator is operative to regulate the fuel pressure from the fuel pump to the low set pressure when the operation fluid pressure is increased.

3. The fuel supply apparatus as set forth in claim 1, in which the fuel consumption unit is constituted by a fuel injection unit of an internal combustion engine, and the set pressure changing unit is operative to lower the operation fluid pressure to have the set pressure of the pressure regulator transferred to the high set pressure in advance of the internal combustion engine being stopped when the internal combustion engine is stopped.

4. The fuel supply apparatus as set forth in claim 1, in which the set pressure changing unit is operative to maintain the operation fluid pressure at an atmospheric pressure to have the set pressure of the pressure regulator transferred to the high set pressure before the fuel pump is driven.

5. The fuel supply apparatus as set forth in claim 3, which further comprises a check valve provided between the fuel pump and the pressure regulator and operative to be opened when the fuel is supplied to the fuel injection unit of the internal combustion engine from the fuel pump and to check the fuel reversed in a backward direction to the fuel pump from the fuel injection unit of the internal combustion engine, and in which the set pressure changing unit is operative to supply the operation fluid pressure to the pressure regulator on the basis of the pressure of the fuel at the upstream of the check valve.

6. The fuel supply apparatus as set forth in claim 5, which the set pressure changing unit is constituted by an electromagnetic valve operative to supply the fuel discharged from the fuel pump to the pressure regulator as the operation fluid pressure when the electromagnetic valve is not energized.

7. The fuel supply apparatus as set forth in claim 6, in which the electromagnetic valve is constituted by a three-way valve having a first port allowing the fuel from the fuel pump to be introduced therein, a second port allowing the operation fluid pressure to be supplied to the pressure regulator, and a third port allowing the internal pressure of the fuel tank or the atmospheric pressure to be introduced therein, the first port being held in communication with the second port when the three-way valve is not energized while the third port being held in communication with the second port when the three-way valve is energized.

8. The fuel supply apparatus as set forth in claim 3, in which the pressure regulator comprises a case, a fuel pressure regulation valve provided in the case and operative to assume an opened state and an closed state, the fuel pressure regulation valve being operative to regulate the fuel pressure by discharging the fuel from the fuel pump to the fuel tank when the fuel pressure regulation valve is held in an opened state, a first urging unit for urging the fuel pressure regulator toward the closed state to have the fuel pressure regulator held in the closed state until the fuel pressure from the fuel pump reaches the high set pressure, and a second urging unit for urging the fuel pressure regulator toward the opened state on the basis of the operation fluid pressure.

9. The fuel supply apparatus as set forth in claim 8, in which the pressure regulator comprises a separation wall member having a displaceable portion constructed to separate the case into a pressure regulation chamber and a back pressure chamber and displaceable in response to the difference in fuel pressure between the pressure regulation chamber and the back pressure chamber, the fuel pressure regulation valve being operative to be opened and closed in response to the displaced positions of the displaceable portion in the pressure regulation chamber.

10. The fuel supply apparatus as set forth in claim 9, in which the second urging unit has a pressure receiving member provided in the case to form an operation pressure chamber allowing the operation fluid pressure introduced in the case and to receive the operation fluid pressure in the pressure operation pressure chamber, the pressure receiving member being operative to transmit the operation force from the pressure receiving member to the displaceable portion in the direction in which the fuel pressure regulation valve is brought into the opened state.

11. The fuel supply apparatus as set forth in claim 10, in which the second urging unit has a resilient member provided between the pressure receiving member and the displaceable portion of the separation wall member to transmit the operation force from the pressure receiving member to the displaceable portion in the direction in which the fuel pressure regulation valve is brought into the opened state.

12. The fuel supply apparatus as set forth in claim 10, in which the operation pressure chamber is positioned in opposing relationship with the back pressure chamber across the pressure regulation chamber, the pressure receiving member having a one side pressure receiving portion positioned in the operation pressure chamber and the other side operation force transmitting portion positioned in the pressure regulation chamber.

13. The fuel supply apparatus as set forth in claim 10, in which the first urging unit has a resilient member provided between the inner bottom portion and the separation wall portion of the case in the back pressure chamber to be used for setting the high pressure of the fuel, the case being formed with an opening hole for allowing the back pressure chamber to be opened to the exterior space of the case.

* * * * *